US006284446B1

(12) United States Patent
Yoshida et al.

(10) Patent No.: US 6,284,446 B1
(45) Date of Patent: Sep. 4, 2001

(54) SILVER HALIDE COLOR PHOTOGRAPHIC MATERIAL AND DEVELOPMENT PROCESSING METHOD OF THE SAME

(75) Inventors: Kazuaki Yoshida; Yasuaki Deguchi; Hiroyuki Yoneyama, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/594,358

(22) Filed: Jun. 14, 2000

(30) Foreign Application Priority Data

Jun. 16, 1999 (JP) ..... 11-170137

(51) Int. Cl.[7] ..... G03C 1/46
(52) U.S. Cl. ..... 430/541; 430/374
(58) Field of Search ..... 430/541

(56) References Cited

U.S. PATENT DOCUMENTS

| | | | |
|---|---|---|---|
| 2,417,514 | 3/1947 | Neumann . | |
| 5,264,337 | 11/1993 | Maskasky | 430/567 |
| 5,320,938 | 6/1994 | House et al. | 430/567 |

FOREIGN PATENT DOCUMENTS

| | | |
|---|---|---|
| 811185 | 4/1959 | (GB) . |
| 3-229249 | 10/1991 | (JP) . |
| 3-246543 | 11/1991 | (JP) . |
| 4-443 | 1/1992 | (JP) . |
| 4-97355 | 3/1992 | (JP) . |
| 5-303182 | 11/1993 | (JP) . |
| 6-59421 | 3/1994 | (JP) . |
| 7-239538 | 9/1995 | (JP) . |
| 7-239539 | 9/1995 | (JP) . |
| WO 87/04534 | 7/1987 | (WO) . |

*Primary Examiner*—Hoa Van Le
(74) *Attorney, Agent, or Firm*—Sughrue, Mion, Zinn, Macpeak & Seas, PLLC

(57) ABSTRACT

A multilayer silver halide color photographic material, wherein when the multilayer silver halide color photographic material is development processed with a color developing solution containing a p-phenylenediamine derivative as a color developing agent, the relationship between the development proceeding velocity a of the lowermost layer of the constituting emulsion layers of the photographic material and the development proceeding velocity b of the uppermost layer satisfies the following equation (R-1):

$$0.65 \leqq a/b \leqq 2.0 \qquad \text{(R-1)}$$

provided that the development proceeding velocity is expressed by the reciprocal of the developing time required for the density value by development to reach ½ of the maximum density.

12 Claims, No Drawings

SILVER HALIDE COLOR PHOTOGRAPHIC MATERIAL AND DEVELOPMENT PROCESSING METHOD OF THE SAME

FIELD OF THE INVENTION

The present invention relates to a silver halide color photographic material and the developing process of the same and particularly relates to color paper for forming a color print and the developing process of the same. Above all, the present invention relates to a silver halide color photographic material which does not cause deterioration of photographic quality with rapid processing, such as stains on the white background and development unevenness, and relates to the developing process of the same.

BACKGROUND OF THE INVENTION

Processing of a silver halide color photographic material fundamentally comprises color development and desilvering steps and the desilvering step comprises bleaching and fixing steps or blixing step performing these steps in one step. If necessary, washing, stopping, stabilization, and pretreatment for accelerating development are included.

In recent years, it is strongly desired in the market of color photography to shorten the time period from receiving photographed color films from users, development processing the films and printing on color papers, until delivering the finished color prints to users. Therefore, expediting the development of not only color negative films but also color papers have been increasingly required. As the color paper capable of rapid development to cope with this requirement, the color paper using high silver chloride content emulsion disclosed in WO 87/04534 and the rapid processing technique applicable thereto have been introduced to the color photographic market to be generally used.

However, with the recent prevalence of the small scale processing station called a store lab or a mini-lab, further shortening of development processing time has been strongly demanded, hence now the needs of the market are not sufficiently met even with the above generally used rapid processing technique. Therefore, the technique of expediting development has been eagerly advanced from both sides of the photographic material and the development processing method even after the introduction of the above color paper using high silver chloride content emulsion to the color photographic market.

That is, in addition to the means for expedition means, such as high temperature rapid development, high pH development and increment of the concentrations of developers, from the side of the development processing method, JP-A-3-246543 (the term "JP-A" as used herein means an "unexamined published Japanese patent application") proposes a rapid development processing technique in which a color developing agent having a carbamoyl group as the N-substituent is used. JP-A-3-229249 and JP-A-4-443 disclose a rapid development processing technique in which a color developing agent having a hydroxypropyl group and the like as the N-substituent is used. Further, a rapid development processing technique in which a color developing agent having a hydroxypropyl group as the N-substituent is applied to color paper having an undercoat layer comprising gelatin having dispersed therein titanium oxide is disclosed in JP-A-6-59421. Further, a rapid development processing technique in which a general purpose color developing agent having a hydroxyethyl group as the N-substituent is combined with N-alkylhydroxylamine having a water-soluble group as the alkyl group is disclosed in JP-A-4-97355. These techniques of expediting development have drawbacks that the developing agents which are not commercially available at present are used, therefore, widely used common processing on the market cannot be performed. As the method of using a development accelerator, British Patent 811,185 discloses a technique of expediting development using 1-phenyl-3-pyrazolidones and U.S. Pat. No. 2,417,514 discloses a technique of using N-methyl-p-aminophenols. However, widely used common processing on the market cannot be performed also in these methods.

On the other hand, from the side of the photographic material, the improving techniques of developing properties such as uniformization of emulsion grain size of color paper, combination with reduction sensitization, and the use of spectral sensitizers for inhibiting fog without impairing development speed are proposed. For example, methods of shortening development processing time by providing a magenta coloring layer and a cyan coloring layer at the position farther from the support are disclosed in JP-A-7-239538 and JP-A-7-239539. In U.S. Pat. Nos. 5,320,938 and 5,264,337, tabular {100} grains having high spectral sensitization effect are disclosed. In addition, means of expediting development by the layer arrangement of not making a blue-sensitive emulsion layer the undermost emulsion layer, and reducing gelatin coating amount to reduce the layer thickness are disclosed in JP-A-5-303182.

Speeding up development processing has been advanced from both sides of the photographic material and the development processing method as described above, but new problems have arisen with the expedition of development processing. That is, the first problem is that the generality on the market of the global color photography is lost because specific development accelerating materials which are not used in general development processing must be used, as has already been described. The second problem is that in the rapid processing in which conventionally used processing materials are used or even in the case of rapid processing type photographic materials to which conventional processing is applicable, the white background of a color print is colored and stained due to the increment of fog. The third problem is that the unevenness by development processing is liable to occur due to rapid development. In particular, development unevenness is easy to occur when a conveyance rate is small as in the mini-lab, and the solution of this problem is strongly desired. The fourth problem is that the deterioration of photographic characteristics is caused due to the mixture of a blixing solution into a color developing solution. The more the development becomes rapid, the more actualized the deterioration of photographic characteristics by the mixture of a blixing solution. The deterioration of photographic characteristics by the mixture of a blixing solution means the fluctuation of sensitivity, the fluctuation of gradation and the increase of stains on the white background (fog). When sensitivity and gradation are fluctuated, the color balance among cyan, magenta and yellow is lost, as a result the color reproduction is impaired and the commodity value of the color print is lowered. Further, stains on the white background detract from the white of the highlight part and reduce the commodity value.

Accordingly, for further shortening the development processing time of color papers, drawbacks attendant upon the speedup of development processing such as deterioration of photographic characteristics, e.g., stains on the white background, development unevenness, and sensitivity reduction due to the mixture of a blixing solution into a color developing solution should be solved, and it is further desired to solve these problems with easily commercially available general purpose developing materials alone.

SUMMARY OF THE INVENTION

The present invention has been done based on the above-described background. That is, an object of the present invention is to provide color paper which is not accompanied by stains on the white background, development unevenness, and sensitivity reduction due to the mixture of a blixing solution into a color developing solution, and can provide a printed matter having satisfactory quality even when the developing time is shortened drastically, and another object is to provide a development processing method of the same, and further preferably to provide color paper which is not accompanied by stains on the white background, development unevenness, and sensitivity reduction due to the mixture of a blixing solution into a color developing solution by means of the developing process using easily commercially available general purpose developing materials alone, and to provide development processing method of the same.

Considering the fact that the above objects have not been solved in spite of the strong demand on the market, the present inventors have thought that there are limits to respective techniques of the photographic material and the development process and searched for the resolving means in the light of the interaction between the material and the development process rather than further technical improvement of respective techniques. As a result, the present inventors have found that the above objects can be achieved by the synergistic effect between the photographic material and the development process factors. The conditions, i.e., the methods of the present invention, are as follows.

1. A multilayer silver halide color photographic material, wherein when the multilayer silver halide color photographic material is development processed with a color developing solution containing a p-phenylenediamine derivative as a color developing agent, the relationship between the development proceeding velocity a of the lowermost layer of the constituting emulsion layers of the photographic material and the development proceeding velocity b of the uppermost layer satisfies the following equation (R-1):

$$0.65 \leqq a/b \leqq 2.0 \quad \text{(R-1)}$$

provided that the development proceeding velocity is expressed by the reciprocal of the developing time required for the density value by development to reach ½ of the maximum density.

2. The multilayer silver halide color photographic material as described in the above item 1, wherein the relationship between the development proceeding velocity a of the lowermost layer of the constituting emulsion layers of the photographic material and the development proceeding velocity b of the uppermost layer satisfies the following equation (R-2):

$$1.0 < a/b \leqq 1.5 \quad \text{(R-2)}$$

provided that the development proceeding velocity is the velocity as defined in the above item 1.

3. A multilayer silver halide color photographic material, wherein the relationship between the development proceeding velocity c of the blue-sensitive emulsion layer of the constituting emulsion layers of the photographic material and the development proceeding velocity d of the red-sensitive emulsion layer satisfies the following equation (R-3):

$$1.0 < c/d \leqq 1.5 \quad \text{(R-3)}$$

provided that the development proceeding velocity is expressed by the reciprocal of the developing time required for the density value by development to reach ½ of the maximum density.

4. The multilayer silver halide color photographic material as described in the above item 1, 2 or 3 which comprises a support having provided thereon at least a blue-sensitive emulsion layer, a red-sensitive emulsion layer and a green-sensitive emulsion layer, wherein the blue-sensitive emulsion layer is positioned farther than at least any one of other emulsion layers from the support.

5. A method for development processing a multilayer silver halide color photographic material, wherein the development processing is performed in a manner that the relationship between the development proceeding velocity of the lowermost layer of the constituting emulsion layers of the multilayer silver halide color photographic material and the development proceeding velocity b of the uppermost layer satisfies the following equation (R-1):

$$0.65 \leqq a/b \leqq 2.0 \quad \text{(R-1)}$$

provided that the development proceeding velocity is expressed by the reciprocal of the developing time required for the density increasing value by development to reach ½ of the maximum ultimate density value.

The following photographic material and development processing method can be exemplified as the preferred embodiments of solving means of the objects of the present invention.

(1) The multilayer silver halide color photographic material as described in any of the above item 1, 2, 3 or 4, wherein the average grain size (the diameter corresponding to the sphere in terms of volume: equivalent sphere diameter) of the entire silver halide emulsion grains contained in the silver halide emulsion layer containing a yellow dye-forming coupler is from 0.1 to 0.6 $\mu$m.

(2) A method for development processing a multilayer silver halide color photographic material which satisfies the condition between the development proceeding velocity a of the lowermost layer of the constituting emulsion layers of the multilayer silver halide color photographic material and the development proceeding velocity b of the uppermost layer in equation (R-1) described in the above item 5 further satisfies the following equation (R-2):

$$1.0 < a/b \leqq 1.5 \quad \text{(R-2)}$$

provided that the development proceeding velocity is the velocity as defined in the above item 1.

(3) A method for development processing a multilayer silver halide color photographic material, wherein the development processing is performed in a manner that the relationship between the development proceeding velocity c of the blue-sensitive emulsion layer of the constituting emulsion layers of the multilayer silver halide color photographic material and the development proceeding velocity d of the red-sensitive emulsion layer satisfies the following equation (R-3):

$$1.0 < c/d \leqq 1.5 \quad \text{(R-3)}$$

provided that the development proceeding velocity is expressed by the reciprocal of the developing time required for the density value by development to reach ½ of the maximum density.

(4) The method as described in the above item 5 for development processing a multilayer silver halide color photographic material comprising a support having provided thereon at least a blue-sensitive emulsion layer, a red-sensitive emulsion layer and a green-sensitive emulsion layer, wherein the blue-sensitive emulsion layer is positioned farther from the support than at least any one of other emulsion layers, and the development processing is performed in a manner that the relationship between the development proceeding velocity a of the lowermost layer of the constituting emulsion layers and the development proceeding velocity b of the uppermost layer satisfies at least equation (R-1).

(5) The method for development processing a multilayer silver halide color photographic material as described in the above item 5, wherein the development processing is performed with a color developing solution containing at least one of 4-amino-3-methyl-N-ethyl-N-[β-(methanesulfonamido)ethyl]aniline, 4-amino-3-methyl-N-ethyl-N-(β-hydroxyethyl)aniline, and salts of these compounds as a color developing agent.

(6) The method for development processing a multilayer silver halide color photographic material as described in the above item 5, wherein the color developing time is 14 seconds or less.

(7) The method for development processing a multilayer silver halide color photographic material as described in the above item 5, wherein the silver coating amount on the multilayer silver halide color photographic material to be development processed is 0. 4 $g/m^2$or less, and the coating amount of solid matters other than silver is 0.7 $g/m^2$ or less.

As described above, although the development accelerating means from the development processing side such as the temperature and pH of a developing solution, a color developing agent, and a development accelerator, and the development accelerating means from the photographic material side such as the addition of development accelerating materials, the producing method of emulsion grains, the improvement of chemical sensitization and spectral sensitization contribute to expediting development, but are attended with stains on the white background and development unevenness, therefore, there are limits to the expedition of development from the techniques of the photographic material and the development process. It is confirmed that, in general, when the development velocity (i.e., late) increases, the development velocity of the emulsion layer near the surface becomes particularly rapid presumably because the emulsion layer is hardly influenced by other emulsion layers. The present inventors have found that the means for increasing the development velocity widens the difference of the developing velocity between the emulsion layer near the surface and the interior emulsion layer, which causes the stain on the white background and development unevenness. As a result of eager investigation of the solving means thereof by the present inventors, the present invention has been achieved by the above-described items of from 1 to 5 and from (1) to (7). The cardinal point of the present invention is that the expedition of development without causing the stain on the white background and development unevenness can be attained by controlling the development proceeding velocities of the uppermost emulsion layer and the lowermost emulsion layer of the color photographic material so as to satisfy at least equation (R-1) or equation (R-2) Further, when the development proceeding velocities of the uppermost emulsion layer and the lowermost emulsion layer are controlled so as to satisfy equation (R-3), the deterioration of photographic characteristics due to the mixture of a blixing solution into a color developing solution (e.g., lowering of color density and color mixture) is markedly improved. The equations may be satisfied by the improvement of photographic materials, by the improvement of development processing methods, or may be satisfied by the combination of both improvements of photographic materials and development processing methods. Each technique of photographic materials and development processing methods does not need to be novel and any well-known technique can be used alone or in combination. What is essential is that the techniques of the photographic material and the development processing are used in combination so that the above-described relationship is exhibited between the development proceeding velocities of the uppermost layer and the lowermost layer or between the blue-sensitive layer and the red-sensitive layer.

The development proceeding velocity used in the present invention is not the generally used time period until completion of the development reaction, i.e., the time period to reach the maximum density, but is the reciprocal of the developing time required for the density value by development to reach ½ of the maximum density, as described above. The maximum ultimate density is the density of the time when the maximum density part of the characteristic curve, i.e., the part subjected to sufficient exposure, is developed for sufficient time for completing the development. Accordingly, the developing time required to reach ½ of the maximum density is the developing velocity (i.e., rate) showing the development progress at a relatively early stage. That is, it can also be said that the present invention is the expedition of development achieved by aiming at the initial velocity of development progress not the time until the completion of development reaction.

Further, the development proceeding velocity is the development velocity of the part developed in a neutral color with photo-wedge for sensitometry or gray step part of color patch, i.e., a gray colored part not color-separated.

DETAILED DESCRIPTION OF THE INVENTION

The present invention will be described in detail below.

For exhibiting the effect of the present invention, it is necessary for the relationship between the development proceeding velocity a of the lowermost layer of the constituting emulsion layers of the photographic material and the development proceeding velocity b of the uppermost layer to satisfy equation (R-1), preferably equation (R-2). This means that by increasing the development proceeding velocity of the lowermost emulsion layer, which is in general slower than that of the uppermost emulsion layer, preferably more rapid than that of the uppermost emulsion layer, the stain on the white background and development unevenness are difficult to occur even when rapid development is performed. Further, it is more preferred to make the velocity of the blue-sensitive emulsion layer rapid so that the development velocity of the blue-sensitive emulsion layer satisfies equation (R-3).

In color papers in recent years, couplers are dissolved in a lipophilic solvent and the solution is added to emulsion layers having dispersed in a hydrophilic medium, and in such coupler dispersion system color papers, a blue-sensitive emulsion layer is in general the lowermost layer. However, in the present invention, for satisfying the above-described equations concerning the relationship between the development velocities of the uppermost layer and the lowermost layer, a blue-sensitive emulsion layer is not necessary to be at least the lowermost layer, and it is particularly effective to make a blue-sensitive emulsion layer the uppermost emulsion layer for realizing rapid development not attended with the above-described drawbacks.

According to the relationship between the development proceeding velocities of the constituting emulsion layers satisfying the condition of the present invention, commonly used p-phenylenediamine derivatives, not special color developing agents as described above, can be used in the present invention as a color developing agent, and particularly preferred are developing agents selected from among 4-amino-3-methyl-N-ethyl-N-[β-(methanesulfonamido)ethyl]-aniline and 4-amino-3-methyl-N-ethyl-N-(β-hydroxyethyl)aniline or salts of these compounds which are widely used on the global color photographic market and easily available. Particularly preferred are 4-amino-3-methyl-N-ethyl-N-[β-(methanesulfonamido)ethyl]aniline and salts thereof, and these developing agents can be used in combination with 4-amino-3-methyl-N-ethyl-N-(β-hydroxyethyl)aniline or salts thereof.

In the next place, the techniques for expediting the development while satisfying at least equation (R-1), preferably (R-2) and (R-3), will be described below. As the expediting means which satisfy these equations, the technique of emulsion which expedites development of particularly the emulsion in the lowermost emulsion layer, the technique of development of a deep layer development type in which a developing solution expedites development of the lower layer of an emulsion layer more rapidly than the upper layer can be used, and more preferably both techniques are used in combination. For that purpose, the expediting means of development processing are selected from among the later-described color paper photographic materials and development processing methods thereof and combined so that the above equations are satisfied. Each technique to be combined may be well-known emulsion techniques and development processing techniques. As the examples of techniques which can be selected for satisfying equation (R-1), preferably (R-2) and (R-3), the following photographic materials and development processing techniques can be exemplified, but means of the present invention are not limited thereto and widely selected from the later-described photographic materials and development processing techniques.

The main techniques which can be used for expediting development processing of the present invention are shown below.

The following techniques can be exemplified as the expediting means of development from the photographic material side.

(1) Thinning of Emulsion Layer

Thinning of an emulsion layer is particularly effective to increase the development velocity of a lower layer. A representative means is to reduce the binder amount as compared with the amounts of silver halide grains and couplers.

(2) Atomization of Emulsion Grains

Development proceeding can be increased by the atomization of emulsion grains, and the atomization of a blue-sensitive emulsion whose development proceeding is generally slow is effective. For that purpose, it is preferred that the average grain size (the diameter corresponding to the sphere in terms of volume) of the entire silver halide emulsion grains contained in the silver halide emulsion layer containing a yellow dye-forming coupler is from 0.1 to 0.6 μm.

(3) Using Tabular Emulsion Grains

If the silver amount of grains is the same, tabular grains are effective in view of rapid development velocity.

(4) Modification of Emulsion Layer Constitution

The emulsion layer constitution having an emulsion layer showing slow development proceeding velocity in the vicinity of the surface, i.e., to make a blue-sensitive layer the uppermost layer, contributes to expediting development.

(5) Adjustment of Swelling Rate of Binder

The swelling rate of a photosensitive layer is preferably from 1.7 to 8.0, more preferably from 2.0 to 5.0 and still more preferably from 2.5 to 4.0. When the swelling rate is low, the development proceeding of the lower layer becomes slow presumably because the diffusion rate of the chemicals used in development lowers, while when the swelling rate is high, the development proceeding of the lower layer also becomes slow probably because the diffusion distance of the chemicals used in development increases.

(6) Expedition of Binder Swelling Rate

Rapid swelling of a photosensitive layer at the time when immersed in a developing solution accelerates developing velocity, in particular, the developing proceeding of the lower layer, therefore, it is effective to use a vinylsulfone type hardening agent and a chlorotriazine type hardening agent.

(7) Addition of Development Accelerator

Methods of adding well-known development accelerators such as 1-phenyl-3-pyrazolidone derivatives and bispyridinium salts to an emulsion layer, in particular, a method of adding a non-diffusible development accelerator to a lower layer is also effective.

(8) Reduction of Coating Silver Amount

To reduce a silver amount as far as possible within the range of the necessary level of color density is effective to accelerate development velocity. For that purpose, selections of couplers having less silver equivalent weight, and shapes and crystal phases of silver halide grains are effective.

(9) Use of Rapid Type Couplers in Combination

For instance, combinations of pyrroloazole type couplers with 2-acylaminophenol couplers.

Of the above-described expediting means from the photographic material side, those which relatively largely contribute to the increase of the development proceeding velocity of the lower layer are means (1), (4) and (5).

On the other hand, the following techniques can be exemplified as the expediting means from the development processing side, but the expediting means which can be applied to the present invention are not limited thereto.

(1) Increasing Development Temperature

The development condition in color labs on the market is generally about 38° C. but the developing time can be shortened by increasing the temperature to about 50° C. It is also possible to perform development at further higher temperature but fog and development unevenness are caused conspicuously at such high temperature.

(2) Increasing Concentration of Color Developing Agent

When there is room to further increase the concentration of a color developing agent, the concentration can be increased within the range of not disadvantageously necessitating the prolonged water washing time.

(3) Use of Highly Active Color Developing Agent

The above-described N-hydroxypropyl derivatives can be used as a color developing agent if the use of developing agents not widely used is not restricted.

(4) Increasing pH of Developing Solution

Increasing pH of a developing solution is an effective means so long as the supply of a developing solution does not function to control developing velocity and the generation of fog can be controlled.

(5) Use of Development Accelerator

A development accelerator which accelerates the development of a lower layer, such as thiocyanate, is particularly preferably used.

(6) Addition of Development Inhibitor

Many development accelerating means accelerate development velocity, but show larger accelerating effect to the surface layer, hence the effect is limitative from the viewpoint of development velocity balance among layers. Thus, when well-known development inhibitors having the development inhibiting effect of a surface layer are used in combination with the development accelerating means, development acceleration can be effected. Specifically, combined use of 1-phenyl-5-mercaptotetrazole with sodium thiocyanate can be exemplified.

(7) Combination of Couplers Having High Developability

As will be described later, couplers having excellent developability such as pyrroloazole type couplers and acylaminophenol couplers can be used in combination.

Of these development processing methods, those which show relatively large accelerating effect of the lower layer and effective means are means (5) and (6).

In the present invention, both expediting means of color papers and development processing and well-known arbitrary expediting means other than the above are used in combination.

The cardinal point of the present invention is that the above expediting means are combined so as to satisfy at least the condition of equation (R-1) or equation (R-3), and preferably the condition of equation (R-2).

The silver amount of color paper which can be used in the present invention adopting the above various means, a photographic layer thickness, and materials such as couplers, the layer constitution of the photographic material which can be used in the present invention, the preparing method of silver halide emulsion for use in the photographic material, the development processing method of the photographic material, and developing apparatus are described in detail below.

Constitution of Photographic Material

The constitution of the silver halide color photographic material to be combined with the development processing conditions for satisfying at least equation (R-1) or equation (R-3) will be described in detail below.

Gelatin is used as a hydrophilic binder in the silver halide color photographic material according to the present invention but, if necessary, other gelatin derivatives, graft polymers of gelatin and other high polymers, proteins other than gelatin, sugar derivatives, cellulose derivatives, and homopolymers and copolymers of hydrophilic colloid such as synthetic hydrophilic high molecular substances can be used in combination with gelatin.

Gelatins which can be used in the silver halide color photographic material according to the present invention may be lime-processed gelatin or acid-processed gelatin, further, gelatins produced from cattle bone, cattle skin and pig skin as raw materials may be used, but preferably lime-processed gelatins produced with cattle bone and-pig skin as raw materials.

In the present invention, the total amount of the hydrophilic binder contained in the photosensitive silver halide emulsion layers on the side of the support on which the silver halide emulsion layers are coated to the remotest hydrophilic colloid layer from the support and in non-photosensitive hydrophilic colloid layers is generally from 3.0 g/m$^2$ to 7.4 g/m$^2$, preferably from 3.5 g/m$^2$ to 6.0 g/m$^2$, most preferably from 4.0 g/m$^2$ to 5.5 g/m$^2$. If the amount of the hydrophilic binder is more than the range of the present invention, various problems such that the expedition of color development processing is impaired, leuco cyan dye formation is deteriorated, or expediting processing property in the washing processing step is deteriorated, are actualized and the effect of the present invention cannot be obtained. While when the amount of the hydrophilic binder is less than the range of the present invention, mal-effects resulting from deficient film strength such as stress mark streaks are disadvantageously liable to occur.

The silver halide emulsion layer in the present invention means the layer which contains a silver halide emulsion capable of substantially contributing to color formation upon reaction with couplers by development. Accordingly, the layers containing fine grain emulsion substantially not having sensitivity or layers containing colloidal silver alone and not containing a coupler do not come under the silver halide emulsion layer.

In the present invention, it is preferred that a silver halide emulsion layer containing a yellow coupler is coated farther than at least one of a silver halide emulsion layer containing a magenta coupler and a silver halide emulsion layer containing a cyan coupler from the support, more preferably a silver halide emulsion layer containing a yellow coupler is coated farthest from the support from the point of view of the expedition of color development and desilvering and the decrease of the residual color due to sensitizing dyes.

The oil-soluble components in the photographic constitutional layers in the present invention are lipophilic components which are still existent in the photographic material after processing. Specifically, a high boiling point organic solvent, a coupler, a color mixing preventive, an ultraviolet absorber, a lipophilic additive, a lipophilic polymer or a polymer latex, a matting agent, and a sliding agent come under the category of the oil-soluble component, which are generally added to the photographic constitutional layers as lipophilic fine grain dispersions. Accordingly, a water-soluble dye, a hardening agent, a water-soluble additive, and a silver halide emulsion do not come under the oil-soluble component. Further, a surfactant is generally used when lipophilic fine grains are prepared but the present invention does not include a surfactant in the category of the oil-soluble component. The total amount of the oil-soluble components in the present invention is from 2.0 g/m$^2$ to 4.5 g m$^2$, preferably from 2.5 g/m$^2$ to 4.0 g/m$^2$, and most preferably from 3.0 g/m$^2$ to 3.8 g/m$^2$.

The ratio of the amount of the oil-soluble component to the amount of the hydrophilic binder in the photographic constitutional layers can be set up arbitrarily. The ratio of the oil-soluble component in the photographic constitutional layers exclusive of a protective layer is preferably from 0.05 to 1.50, more preferably from 0.10 to 1.40, and most preferably from 0.20 to 1.30, by weight ratio. Film strength, scratch resistance and curling characteristic can be controlled by making the ratio of each layer optimal.

The film thickness of the photographic constitutional layers in the present invention is preferably from 1.0 $\mu$m to 9.0 $\mu$m, more preferably from 2.0 $\mu$m to 8.0 $\mu$m, and most preferably from 3.5 $\mu$m to 7.0 $\mu$m. The film thickness of the photographic constitutional layers in the present invention means the film thickness before processing of the photographic constitutional layers of the upper side of the support. Specifically, the film thickness of the photographic constitutional layers can be obtained by any of the following methods. In the first place, the thickness can be obtained by cutting the silver halide color photographic material vertically to the support and observing the cut surface with an electron microscope. Secondly, the thickness can be obtained from the coating weight of each component in the photographic constitutional layers (g/m$^2$) and the specific gravity. The specific gravity of representative gelatin for photographic use is 1.34 g/ml and that of silver chloride grain is 5.59/ml, and those of other lipophilic additives can also be measured, thus the film thickness can be obtained by the second method.

A cyan coupler which can preferably be used in the present invention in view of a rapid processing property and a color reproducing property is a pyrroloazole coupler, and the pyrroloazole couplers disclosed in JP-A-5-313324 and JP-A-6-347960 are particularly preferably used. More specifically, the coupler represented by formula (I) or (II) in the above JP-A-5-313324 and the coupler represented by formula (I) in JP-A-6-347960 are preferably used in the present invention. Of these, the coupler represented by the following formula (I) is preferred for its coloring ability and image stability:

(I)

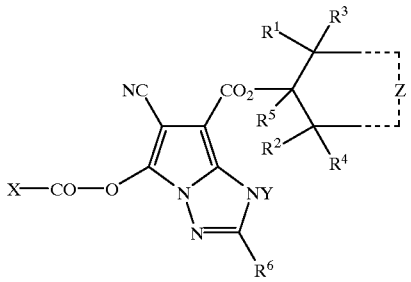

wherein $R^1$ and $R^2$ each represents an alkyl group or an aryl group; $R^3$, $R^4$ and $R^5$ each represents a hydrogen atom, an alkyl group or an aryl group; Z represents a nonmetal atomic group necessary to form a saturated ring; $R^6$ represents a substituent; X represents a heterocyclic ring, a substituted amino group, or an aryl group; and Y represents a hydrogen atom or a group releasing during color development.

In formula (I), the alkyl group represented by $R^1$, $R^2$, $R^3$, $R^4$ and $R^5$ is a straight chain, branched or cyclic alkyl group having from 1 to 36 carbon atoms, preferably a straight chain, branched or cyclic alkyl group having from 1 to 22 carbon atoms, and particularly preferably a straight chain or branched alkyl group having from 1 to 8 carbon atoms, e.g., methyl, ethyl, n-propyl, isopropyl, t-butyl, t-amyl, t-octyl, decyl, dodecyl, cetyl, stearyl, cyclohexyl and 2-ethylhexyl can be exemplified.

In formula (I) , the aryl group represented by $R^1$, $R^2$, $R^3$, $R^4$ and $R^5$is an aryl group having from 6 to 20, preferably from 6 to 14, and particularly preferably from 6 to 10, carbon atoms, e.g., phenyl, 1-naphthyl, 2-naphthyl and 2-phenanthryl can be exemplified.

In formula (I), the nonmetal atomic group necessary to form a saturated ring represented by Z is a nonmetal atomic group necessary to form a 5- to 8-membered ring, and this ring may be substituted and may be saturated or unsaturated, and as the nonmetal atomic group which forms a ring, a carbon atom, an oxygen atom, a nitrogen atom and a sulfur atom can be exemplified. A preferred ring is a 6-membered saturated carbon ring, and particularly preferably a cyclohexane ring the 4-position of which is substituted with an alkyl group having from 1 to 24 carbon atoms.

In formula (I) , examples of the substituents represented by $R^6$ include a halogen atom (e.g., chlorine, bromine), an aliphatic group (e.g., a straight chain or branched alkyl group having from 1 to 36 carbon atoms, an aralkyl group, an alkenyl group, an alkynyl group, a cycloalkyl group, and a cycloalkenyl group, e.g., methyl, ethyl, propyl, isopropyl, t-butyl, tridecyl, t-amyl, t-octyl, 2-methanesulfonylethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl, and 3-(2,4-di-t-amylphenoxy)propyl), an aryl group (an aryl group having from 6 to 36 carbon atoms, e.g., phenyl, 4-t-butylphenyl, 2,4-di-t-amylphenyl, and 4-tetradecanamidophenyl), a heterocyclic group (a heterocyclic group having from 1 to 36 carbon atoms, e.g., imidazolyl, pyrazolyl, triazolyl, 2-furyl, 2-thienyl, 2-pyrimidinyl, and 2-benzothiazolyl), a cyano group, a hydroxyl group, a nitro group, a carboxyl group, an amino group, an alkoxyl group (a straight chain, branched or cyclic alkoxyl group having from 1 to 36 carbon atoms, e.g., methoxy, ethoxy, 2-methoxyethoxy, 2-dodecylethoxy, and 2-methanesulfonylethoxy), an aryloxy group (an aryloxy group having from 6 to 36 carbon atoms, e.g., phenoxy, 2-methylphenoxy, 4-t-butylphenoxy, 3-nitrophenoxy, 3-t-butyloxycarbamoylphenoxy, and 3-methoxycarbamoyl), an acylamino group (an acylamino group having from 2 to 36 carbon atoms, e.g., acetamido, benzamido, tetradecanamido, 2-(2,4-di-t-amylphenoxy)butanamido, 4-(3-t-butyl-4-hydroxyphenoxy)butanamido, and 2-[4-(4-hydroxyphenylsulfonyl)phenoxy]decanamido), an alkylamino group (an alkylamino group having from 1 to 36 carbon atoms, e.g., methylamino, butylamino, dodecylamino, diethylamino, and methylbutylamino), an anilino group (an acylamino group having from 6 to 36 carbon atoms, e.g., phenylamino, 2-chloroanilino, 2-chloro-5-tetradecanaminoanilino, 2-chloro-5-dodecyloxycarbonylanilino, N-acetylanilino, and 2-chloro-5-[2-(3-t-butyl-4-hydraoxyphenoxy)dodecanamido]anilino), a ureido group (a ureido group having from 2 to 36 carbon atoms, e.g., phenylureido, methylureido, and N,N-dibutylureido), a sulfamoylamino group (a sulfamoylamino group having from 1 to 36 carbon atoms, e.g., N,N-dipropylsulfamoylamino, and N-methyl-N-decylsulfamoylamino), an alkylthio group (an alkylthio group having from 1 to 36 carbon atoms, e.g., methylthio, octylthio, tetradecylthio, 2-phenoxyethylthio, and 3-phenoxypropylthio, 3-(4-t-butylphenoxy)propylthio), an arylthio group (an arylthio group having from 6 to 36 carbon atoms, e.g., phenylthio, 2-butoxy-5-t-octylphenylthio, 3-pentadecylphenylthio, 2-carboxyphenylthio, and 4-tetradecanamidophenylthio), an alkoxycarbonylamino group (an alkoxycarbonylamino group having from 2 to 36 carbon atoms, e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (a carbamoyl group having from 1 to 36 carbon atoms, e.g., N-ethylcarbamoyl, N,N-dibutylcarbamoyl, N-(2-dodecyloxyethyl)carbamoyl, N-methyl-N-dodecylcarbamoyl, and N-[3-(2,4-di-t-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazol-5-oxy, and 2-tetrahydropyranyloxy), an azo group (e.g., phenylazo, 4-methoxyphenylazo, 4-pivaloylaminophenylazo, and 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3-octadecenylsuccinimido), a heterocyclic thio group (e.g., 2-benzothiazolylthio, 2,4-diphenoxy-1,3,5-triazole-6-thio, and 2-pyridylthio), a sulfinyl group (e.g., dodecansulfinyl, 3-pentadecylphenylsulfinyl, and 3-phenoxypropylsulfinyl), an aryloxycarbonyl group (e.g., phenoxycarbonyl), an acyl group (e.g., acetyl, 3-phenylpropanoyl, benzoyl, and 4-dodecyloxybenzoyl), a hydroxyl group, a cyano group, a carboxyl group, a nitro group, a sulfo group, and an unsubstituted amino group.

Preferred substituents are an alkyl group and an aryl group, and more preferred is an aryl group at least substituted with an alkyl group at the p-position.

X represents a heterocyclic ring, a substituted amino group, or an aryl group. The heterocyclic ring is preferably a 5- to 8-membered ring comprising a nitrogen atom, an oxygen atom or a sulfur atom and having from 1 to 36 carbon atoms, more preferably a 5- or 6-membered ring bonded via a nitrogen atom, and particularly preferably a 6-membered ring.

Specific examples of the heterocyclic rings include imidazole, pyrazole, triazole, a lactam compound, piperidine, pyrrolidine, pyrrole, morpholine, pyrazolidine, thiazolidine, and pyrazoline, and preferably morpholine and piperidine, and particularly preferably morpholine.

As the substituents of the substituted amino group, an aliphatic group, an aryl group or a heterocyclic group can be exemplified. As the aliphatic group, the substituents represented by $R^6$ described above can be exemplified, and these substituents may further be substituted with a cyano group, an alkoxyl group (e.g., methoxy), an alkoxycarbonyl group (e.g., ethoxycarbonyl), chlorine, a hydroxyl group, or a carboxyl group. As the substituted amino group, di-substitution is preferred to mono-substitution. The aryl group preferably has from 6 to 36 carbon atoms, more preferably a monocyclic aryl group. Specific examples include phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl, and 2,4-dichlorophenyl.

Y represents a hydrogen atom or a group releasing during color development. As the examples of the substituents represented by Y, a group releasing during color development under alkaline condition as disclosed in JP-A-61-228444, and a substituent coupling-off upon reaction with a developing agent as disclosed in JP-A-56-133734 can be exemplified. Y preferably represents a hydrogen atom.

The coupler represented by formula (I) may be a coupler in which $R^6$ has a coupler residue represented by formula (I) and forms a polymer of a dimer or more, or $R^6$ contains a high molecular chain and forms a homopolymer or copolymer. The homopolymer or copolymer containing a high molecular chain is representatively a homopolymer or copolymer of an addition polymer ethylene type unsaturated compound having a coupler residue represented by formula (I). In this case, the polymer may contain one or more cyan-coloring repeating units having a coupler residue represented by formula (I), and the polymer may contain, as the copolymer component, one or more non-coloring ethylene type monomers which do not couple with the oxidized product of an aromatic primary amine developing agent such as acrylate, methacrylate and maleate.

Specific examples of the couplers for use in the present invention are shown below, the present invention is not limited thereto.

(1)

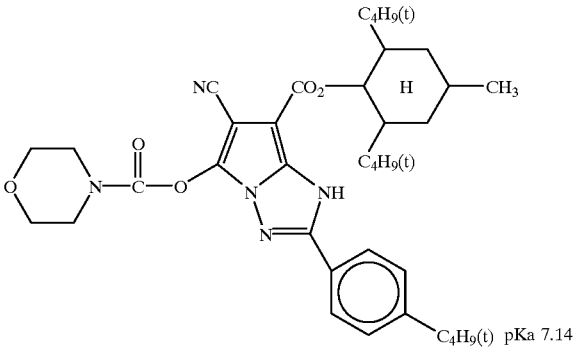

(2)

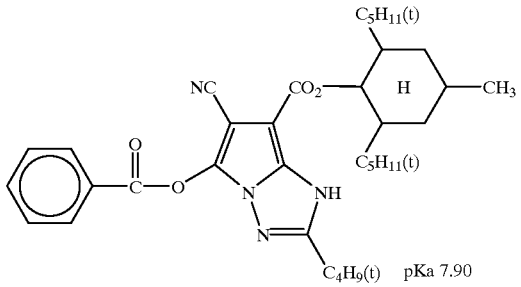

-continued
(3)
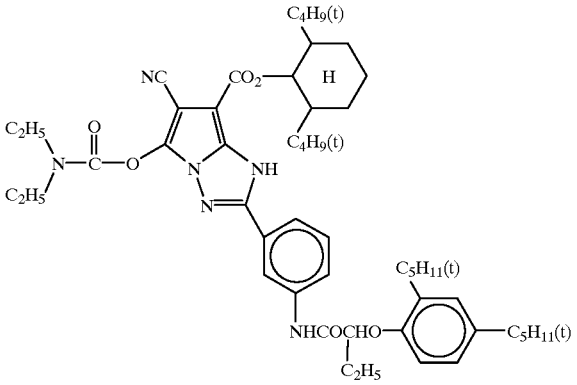
(4)
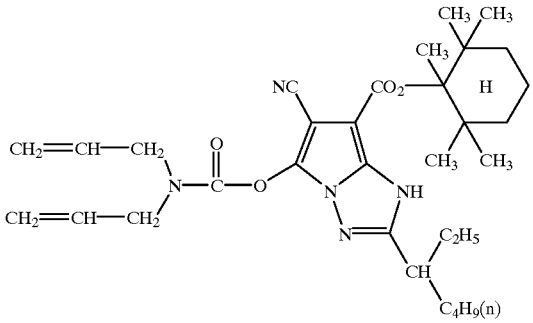
(5)
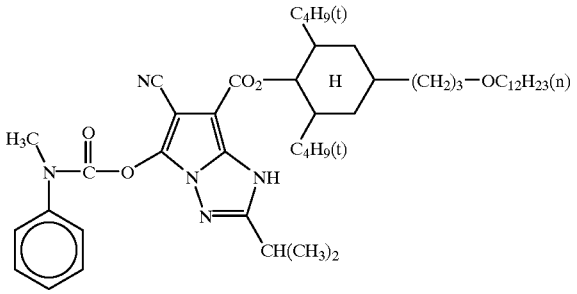
(6)
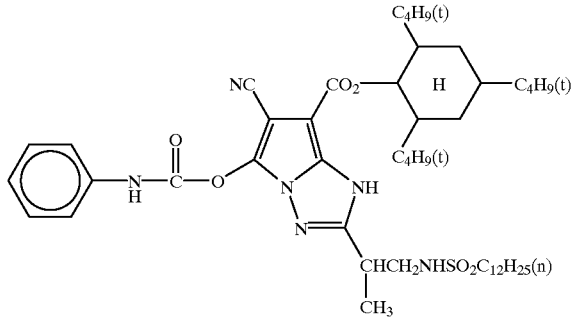

-continued
(7)
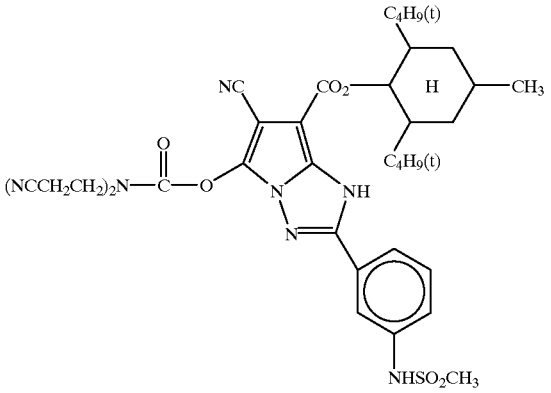
(8)
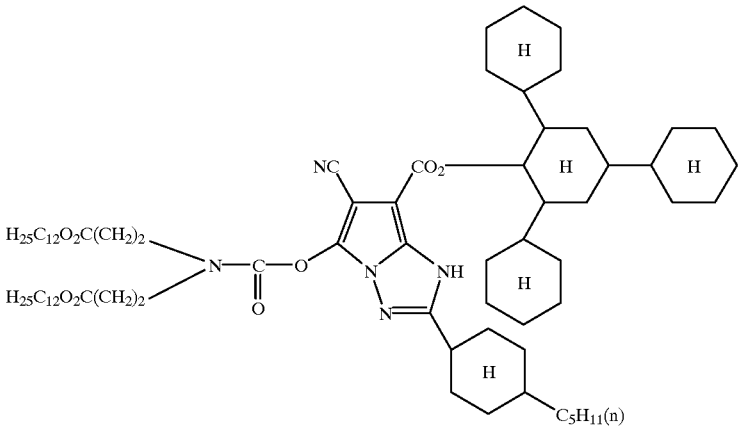
(9)
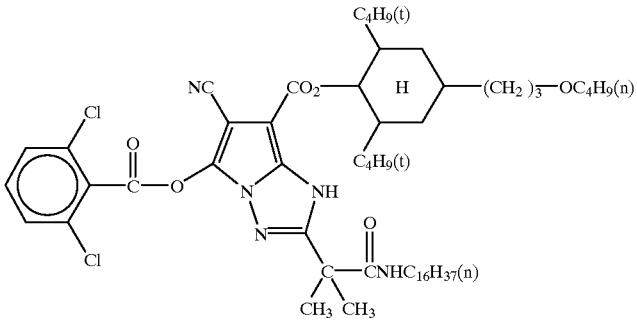

-continued
(10)
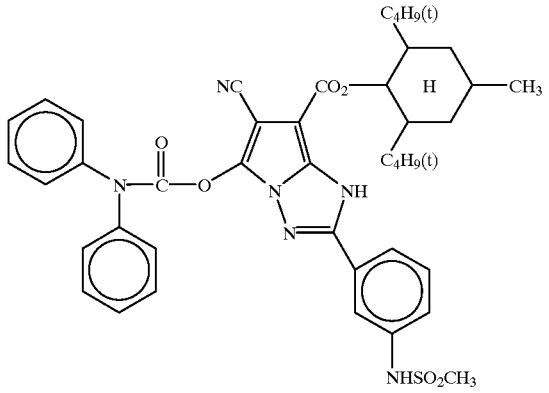
(11)
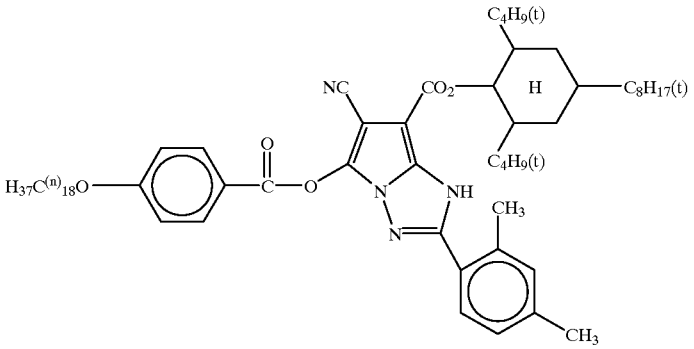
(12)
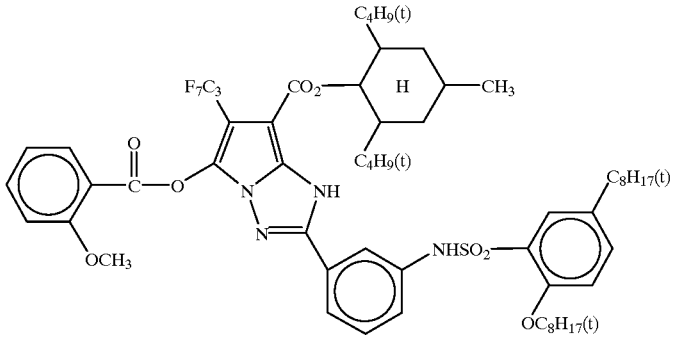
(13)
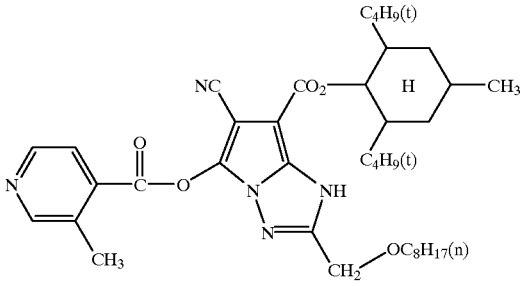

-continued
(14)
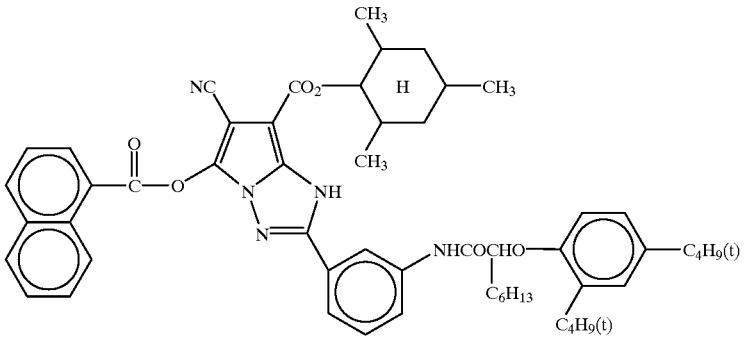
(15)
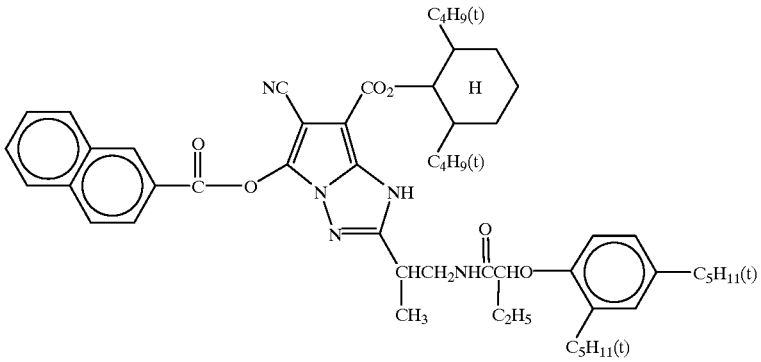
(16)
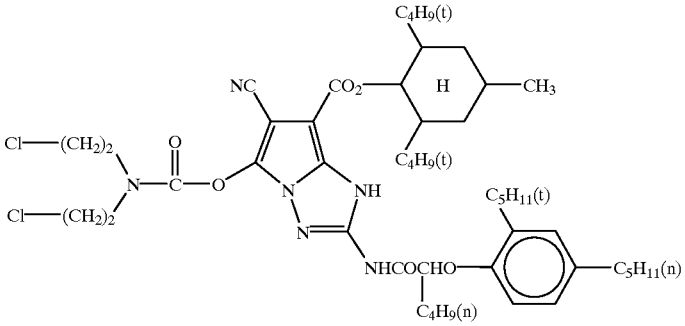
(17)
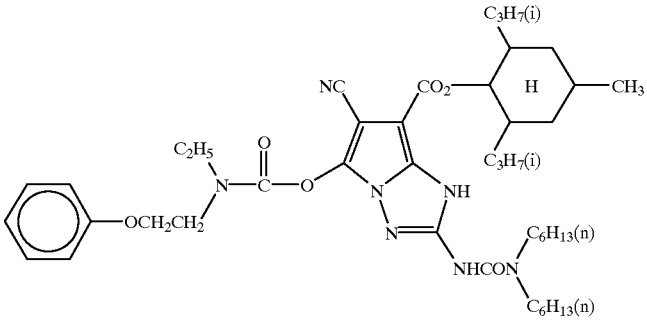

-continued
(18)
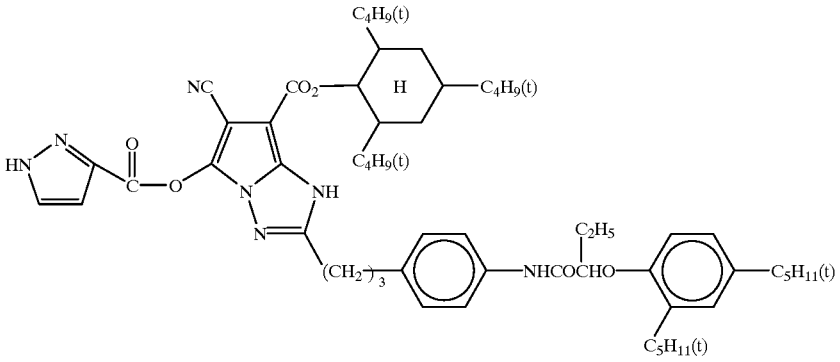
(19)
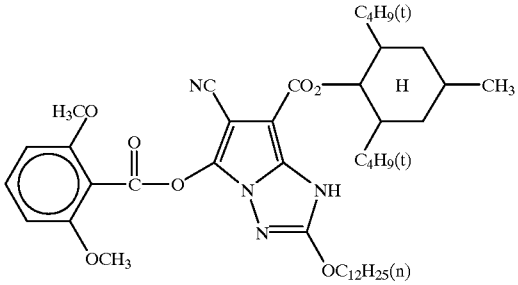
(20)
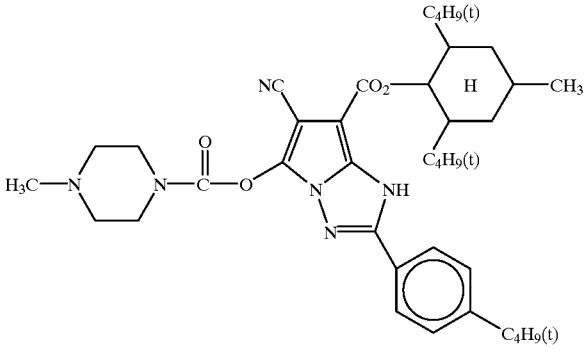
(21)
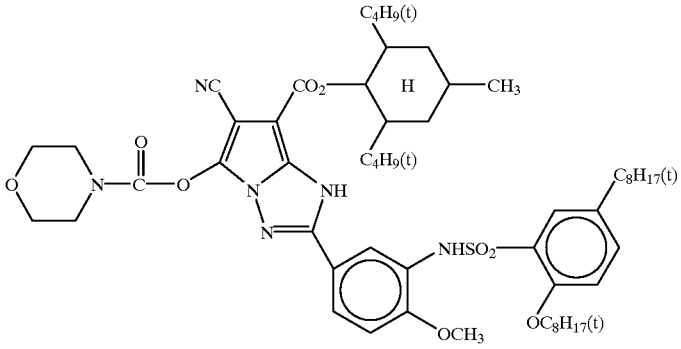
pKa 7.70

-continued
(22)
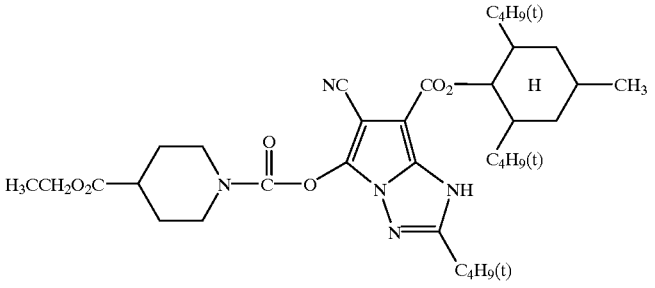
pKa 8.30
(23)
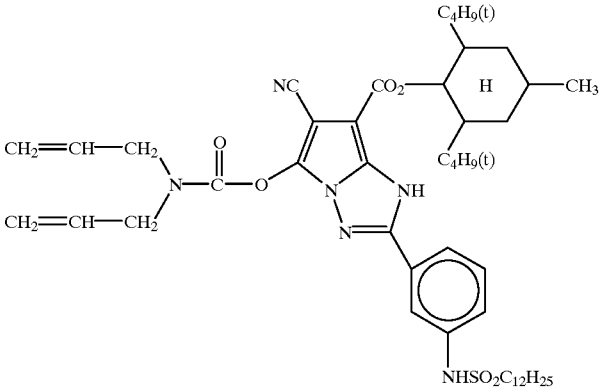
(24)
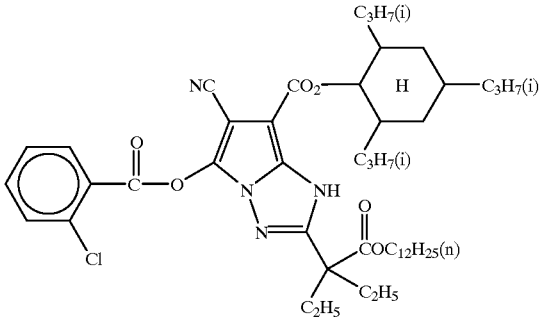
(25)
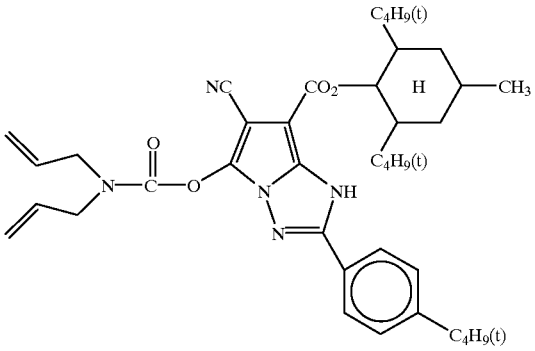
pKa 7.47

-continued
(26)
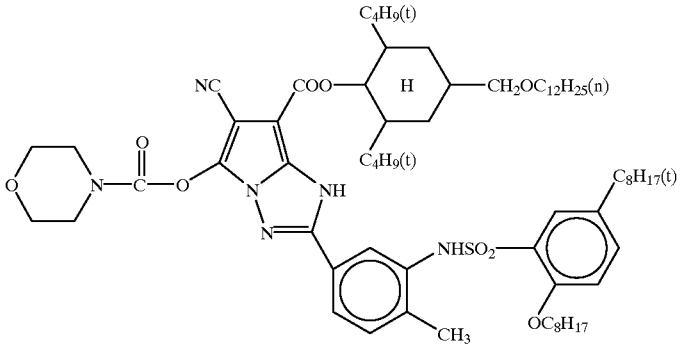
pKa 7.38
(27)
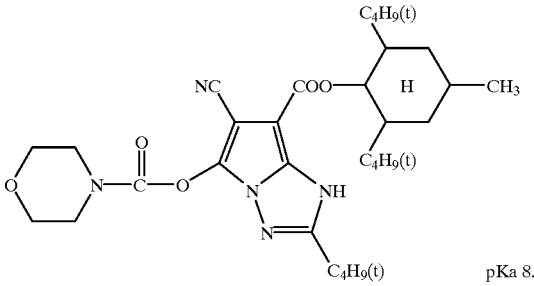
pKa 8.28
(28)
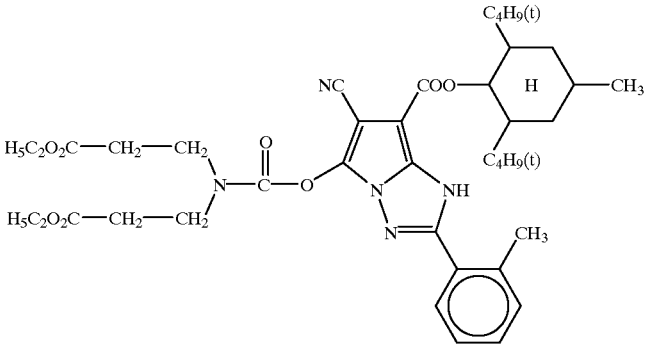
(29)
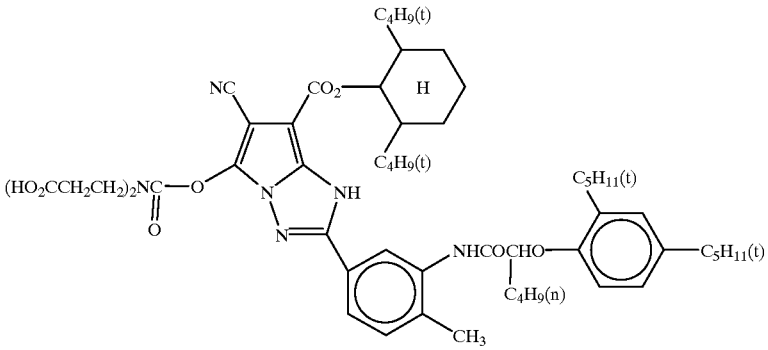

-continued (30)

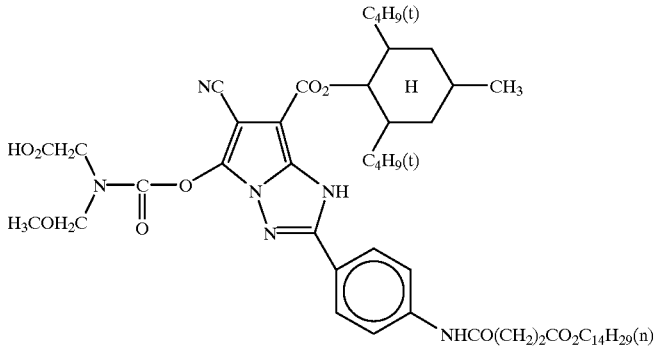

(31)

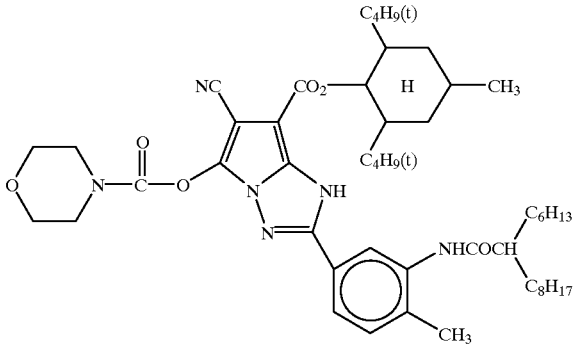

The compound represented by formula (I) can be synthesized according to well-known methods, e.g., methods disclosed in JP-A-5-255333, JP-A-5-202004, JP-A-7-48376 and JP-A-8-110623.

It is also preferred to use a cyan coupler represented by the following formula (ADF) in combination with a coupler represented by formula (I) in a photographic material according to the present invention.

(ADF)

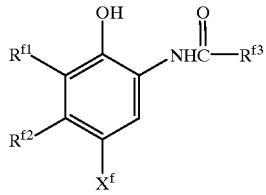

wherein $X^f$ represents a hydrogen atom or a group which is released upon coupling reaction with the oxidant of an aromatic amine developing agent; $R^{f1}$ and $R^{f2}$, which may be the same or different, each represents a hydrogen atom or a substituent; $R^{f3}$ represents an alkyl group, an aryl group, an alkylamino group or an arylamino group, and each group may be substituted with a substituent, and as the substituents, the groups described in $R^6$ in formula (I) are preferred; $R^{f1}$ and $R^{f2}$ may be bonded to each other to form a 5- or 6-membered ring; at least one group represented by $R^{f1}$ to $R^{f3}$ has 8 or more carbon atoms. $R^{f1}$ preferably represents a hydrogen atom, an alkyl group or a halogen atom, $Rf^2$ preferably represents an alkyl group, an acylamino group or a ureido group, and $X^f$ preferably represents a halogen atom or a hydrogen atom.

Specific examples of the compounds represented by formula (ADF) are shown below.

(ADF-1)

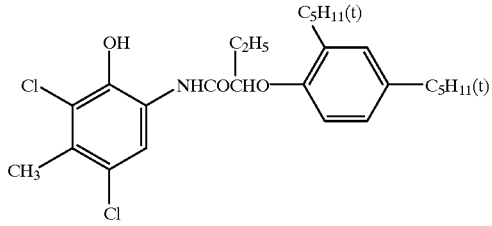

(ADF-2)

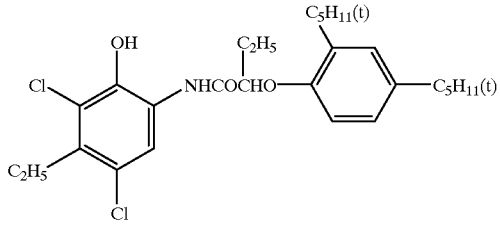

(ADF-3)

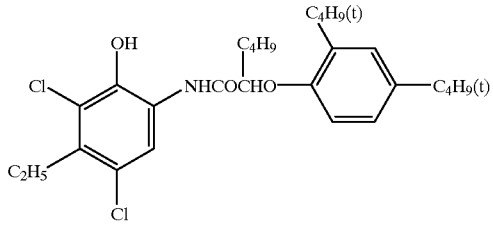

-continued (ADF-4)

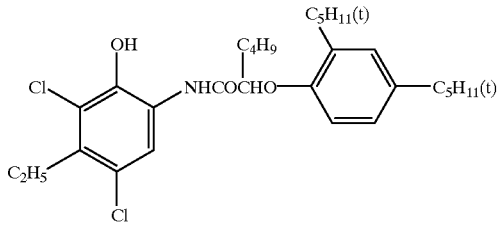

(ADF-5)

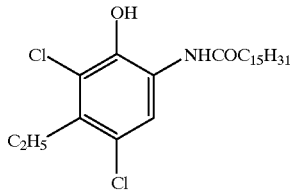

(ADF-6)

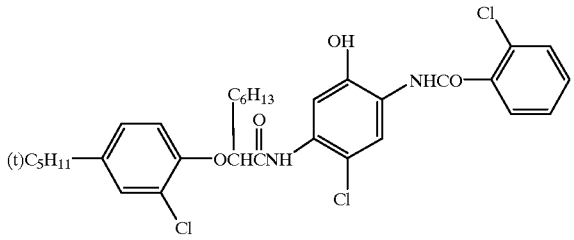

(ADF-7)

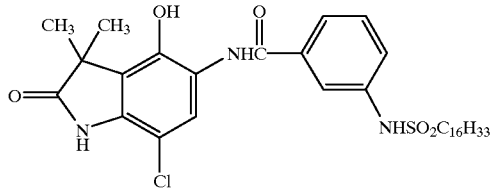

(ADF-8)

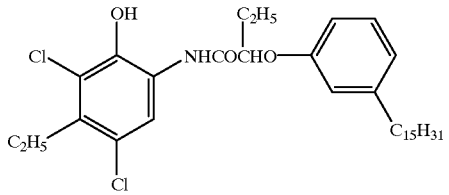

(ADF-9)

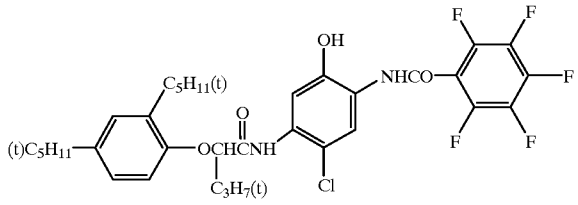

-continued (ADF-10)

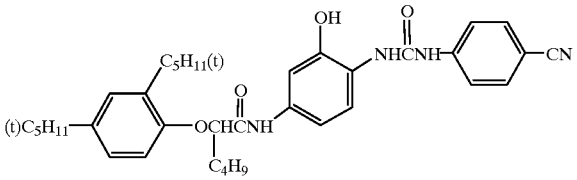

The cyan coupler represented by formula (I) is preferably added to the silver halide emulsion layer nearest to the support. The content of the cyan coupler represented by formula (I) in the photographic material is from $1\times10^{-3}$ to 1 mol, preferably from $2\times10^{-3}$ to $3\times10^{-4}$, per mol of the silver halide contained in the same layer. The cyan coupler represented by formula (ADF) is preferably added to the same layer where the cyan coupler represented by formula (I) is added, and the addition amount thereof is preferably from 1 to 100 mol %, more preferably from 2 to 50 mol %, and most preferably from 2 to 30 mol %, to the amount of the cyan coupler represented by formula (I).

Well-known additives can be added to the cyan coupler represented by formula (I) for the purpose of controlling hue and improving image fastness and processing stability.

For example, the additives disclosed in JP-A-10-221825, JP-A-10-833760, JP-A-11-24217, JP-A-11-24218, JP-A-11-30843, JP-A-11-65050, JP-A-11-109576, JP-A-11-53622 and JP-A-11-258748 are preferably used for those purposes.

The cyan coupler represented by formula (ADF) can be added to a hydrophilic colloid layer adjacent to the silver halide emulsion layer containing the cyan coupler represented by formula (I). The hydrophilic colloid layer may or may not contain a silver halide emulsion at this time, but the content is preferably small from the point of view of color reproducing property and leuco cyan dye formation resistance. Further, it is preferred that the polymers disclosed in JP-A-9-171240 and JP-A-9-329861 be added to the hydrophilic colloid layer for preventing leuco cyan dye formation.

The yellow coupler and magenta coupler for use in the present invention are not particularly restricted and those conventionally used can be used. Specific examples of the couplers are disclosed in the patents listed in Table 1 shown below.

Cyan couplers and other photographically useful compounds can be incorporated into the silver halide photographic material according to well-known dispersing methods, e.g., an oil-in-water dispersing method using a high boiling point organic solvent described later and a latex dispersing method.

In an oil-in-water dispersing method, cyan couplers and other photographically useful compounds are dissolved in a high boiling point organic solvent, and emulsified dispersed in fine grains in hydrophilic colloid, preferably an aqueous solution of gelatin, together with a dispersant such as a surfactant and the like by a well-known dispersing means, e.g., ultrasonic waves, a colloid mill, a homogenizer, a Manton Gaulin, and a high speed dissolver.

In addition, an auxiliary solvent can be used for dissolving couplers and other photographically useful compounds. "An auxiliary solvent" means an organic solvent effective at the time of emulsified dispersion and which has substantially been removed from the photographic material after being subjected to drying step, e.g., lower alcohol acetates such as ethyl acetate and butyl acetate; ethyl propionate, sec-butyl alcohol, methyl ethyl ketone, methyl isobutyl ketone, β-ethoxyethyl acetate, methyl cellosolve acetate, methyl carbitol acetate, methyl carbitol propionate, and cyclohexane can be exemplified.

If necessary, an organic solvent which is completely miscible with water, e.g., methyl alcohol, ethyl alcohol, acetone, tetrahydrofuran, and dimethylformamide can further be used partially in combination. Such organic solvents can be used in combination of two or more.

From the viewpoint of the improvement of the aging stability with the lapse of time of a coupler in an emulsified dispersion state and the inhibition of the change of the photographic properties and the improvement of the aging stability with the lapse of time of the final composition for coating mixed with an emulsion, if necessary, all or a part of the auxiliary solvent can be excluded from the emulsified dispersion by means of reduced pressure distillation, noodle washing or ultrafiltration.

The thus-obtained lipophilic fine grain dispersion preferably has an average grain size of from 0.04 to 0.50 μm, more preferably from 0.05 to 0.30 μm, and most preferably from 0.08 to 0.20 μm. The average grain size can be measured with Calter submicron grain analyzer model N4 (manufactured by Coulter Electronix Co., Ltd.).

In the light of expediting water washing, the use amount of a high boiling point organic solvent and other photographically useful compounds is preferably less, and their total amount by weight ratio to the amount of the coupler is preferably from 0.05 to 8 0, more preferably from 0.1 to 3.0, and most preferably from 0.1 to 2.5. It is also possible not to use a high boiling point organic solvent at all by using a highly active coupler.

Examples of high boiling point organic solvents which can be preferably used in the present invention are disclosed in U.S. Pat. No. 2,322,027 and JP-A-10-221825.

The tabular silver halide grains for use in the present invention are described in detail below. A pair of parallel planes vertical to the thickness direction of a tabular grain are called main planes.

{111} Tabular grains are tabular grains having {111} faces as main planes. With respect to {111} tabular grains, methods of using various crystal phase controlling agents are described. The compounds disclosed in JP-A-2-32 (Compounds 1 to 42) are preferably used in the present invention, and the crystal phase controlling agents disclosed in JP-A-8-227117 are particularly preferred. However, the present invention is not limited thereto.

{111} Tabular grains can be obtained by forming two parallel twin planes. Since the formation of twin planes is influenced by temperature, dispersion medium (gelatin), halogen concentration, etc., appropriate conditions of these factors must be set up. When a crystal phase controlling agent is to be present during nucleation, the concentration of gelatin is preferably from 0.1 to 10%, and the concentration of chloride is 0.01 mol/liter or more, preferably 0.03 mol/liter or more.

It is disclosed in JP-A-8-184931 that a crystal phase controlling agent is preferably not used during nucleation when grains are to be monodispersed. When a crystal phase controlling agent is not used during nucleation, the concentration of gelatin is from 0.03 to 10%, preferably from 0.05 to 1.0%, and the concentration of chloride is from 0.001 to 1 mol/liter, preferably from 0.003 to 0.1 mol/liter. The nucleation temperature can be selected arbitrarily from the temperature of from 2° C. to 90° C., preferably from 5° C. to 80° C., and particularly preferably from 5° C. to 40° C.

The nucleus of a tabular grain is formed in the initial nucleation stage but many nuclei other than tabular grains are contained in the reaction vessel just after nucleation. Therefore, a technique of ripening after nucleation to remain tabular grains alone and vanish other nuclei becomes necessary. When general Ostwald ripening is performed, tabular grains also dissolve and vanish and tabular grain nuclei diminish, as a result, the size of the tabular grains to be obtained increases. A crystal phase controlling agent is added to prevent this situation. In particular, the effect of a crystal phase controlling agent can be increased by using phthalated gelatin in combination and the dissolution of tabular grains can be prevented. The pAg during ripening is particularly important and it is preferably from 60 to 130 mV to a silver-silver chloride electrode.

In the next place, the nuclei formed are grown by physical ripening and the addition of a silver salt and a halide in the presence of a crystal phase controlling agent. At this time, the chloride concentration is 5 mol/liter or less, preferably from 0.05 to 1 mol/liter. The temperature during grain growth is from 10° C. to 90° C., preferably from 30° C. to 80° C.

The total use amount of a crystal phase controlling agent is $6\times10^{-5}$ mol or more, preferably from $3\times10^{-4}$ to $6\times10^{-2}$ mol, per mol of the silver halide in the finished emulsion. The addition time of a crystal phase controlling agent is not limited and may be added at any time of from nucleus forming to physical ripening and during grain growth of silver halide grains. Just after the addition of a crystal phase controlling agent, {111} faces begin to form. A crystal phase controlling agent may be put in a reaction vessel in advance but when small size tabular grains are to be formed, it is preferably added to a reaction vessel with the progress of the grain growth to increase the concentration.

When the amount of the dispersion medium used in nucleation is short for grain growth, it must be compensated for by the addition. It is preferred for gelatin to be present from 10 g/liter to 100 g/liter for grain growth. As the gelatin to be compensated for, phthalated gelatin and gelatin added with trimellitic acid are preferably used.

The pH during grain formation is arbitrary but is preferably from neutral to acidic region.

{100} Tabular grains are described below. {100} Tabular grains are tabular grains having {100} faces as main planes. The shapes of the main planes include a right angle parallelogram, a triangle to a pentagon obtained by losing any one angle of the right angle parallelogram (the lost shape is a right angled triangle part formed by two sides forming the lost angle, with the lost angle as a peak), and a quadrangle to an octagon obtained by losing from two to four angles of the right angle parallelogram. To take the right angle parallelogram whose lost part(s) is remedied as a remedied quadrangle, the adjacent side length ratio (the length of a long side/the length of a short side) of the right angle parallelogram and the remedied quadrangle is from 1 to 6, preferably from 1 to 4, and more preferably from 1 to 2.

Tabular silver halide emulsion grains having {100} main planes are formed by adding an aqueous silver salt solution and an aqueous halide solution into a dispersion medium, e.g., an aqueous gelatin solution, with stirring and mixing and, at this time, for example, there are disclosed in JP-A-6-301129, JP-A-6-347929, JP-A-9-34045 and JP-A-9-96881 methods of introducing crystal defects for imparting to grains anisotropic growing property such as screw dislocation by generating distortion to the nuclei due to the difference in size between silver chloride and crystal lattice in the presence of silver iodide or iodide ion, or silver bromide or bromide ion. When the screw dislocation is introduced, since the formation of two-dimensional nucleus at that plane under low supersaturation condition becomes not determining rate, the crystallization at that plane proceeds, thus tabular grains are formed due to the introduction of the screw dislocation. "Low supersaturation condition" means 35% or less, more preferably from 2 to 20%, of the critical addition. It wasn't that the crystal defects were confirmed to be screw dislocation, but it was thought to be possibly screw dislocation because of the direction of the introduction of dislocation lines and the fact of anisotropic growing property being imparted to the grains. To make tabular grains thinner, it is preferred to maintain the dislocation lines as disclosed in JP-A-8-122954 and JP-A-9-189977.

Methods of forming {100} tabular grains by adding a {100} face-forming accelerator, e.g., imidazoles and 3,5-diaminotriazoles are disclosed in JP-A-6-347928 and polyvinyl alcohols in JP-A-8-339044, but it should not be construed as the present invention is limited thereto.

High silver chloride grains in the present invention means the grains having a silver chloride content of 80 mol % or more, preferably 95 mol % or more. The silver halide grains in the present invention are preferably grains having core/shell structure comprising a core part and a shell part surrounding the core part. Preferably 90 mol % or more of the core part is occupied by silver chloride. The core part may further comprise two or more parts respectively having different halogen compositions. The shell part preferably occupies 50% or less of the entire volume of the grain, particularly preferably 20% or less. The shell part preferably comprises silver iodochloride or silver iodobromochloride. The shell part preferably contains from 0.5 to 13 mol % of iodide, particularly preferably from 1 to 13 mol %. The content of silver iodide in the entire grains is preferably 5 mol % or less, particularly preferably 1 mol % or less.

The content of silver bromide is preferably higher in the shell part than in the core part. The content of silver bromide is preferably 20 mol % or less, particularly preferably 5 mol % or less.

The average grain size (the diameter corresponding to the sphere in terms of volume: equivalent sphere diameter) of the silver halide grains for use in the present invention is not particularly restricted but is preferably from 0.1 to 0.8 μm, particularly preferably from 0.1 to 0.6 μm. The diameter corresponding to the circle (i.e., equivalent circle diameter) is preferably from 0.2 to 1.0 μm. The diameter of a silver halide grain used in the present invention is the diameter of a circle having the same area with the projected area of the grain in an electron microphotograph. The thickness of the grain in the present invention is 0.2 μm or less, preferably 0.1 μm or less, and particularly preferably 0.06 μm or less. In the present invention, 50% or more of the projected area of entire silver halide grains containing yellow dye-forming coupler are preferably occupied by the grains having an average aspect ratio (the diameter/thickness ratio) of 2 or more, preferably from 5 to 20.

The tabular grain in general has two parallel planes hence the thickness in the present invention is expressed as a distance between two parallel planes constituting the tabular grain.

The grain size distribution of the silver halide grains in the present invention may be polydispersion or monodispersion but monodispersed grains are preferred. In particular, the variation coefficient of the equivalent-circle diameter of the tabular grains accounting for 50% or more of the entire projected area is preferably 20% or less, ideally 0%.

When a crystal phase controlling agent is present on the surface of a grain after grain formation, the adsorption of a sensitizing dye and the development are adversely influenced. Therefore, it is preferred to remove the crystal phase controlling agent after grain formation. However, when the crystal phase controlling agent has been removed, it is difficult to maintain {111} faces of high silver chloride content {111} tabular grains under the general conditions. Hence, it is preferred to maintain the grain form by the substitution with photographically useful compounds such as a sensitizing dye, etc. As for these methods, JP-A-9-80656, JP-A-9-106026, U.S. Pat. Nos. 5,221,602, 5,286,452, 5,298,387, 5,298,388 and 5,176,992 can be referred to.

The crystal phase controlling agent is desorbed from the grain according to the above methods, and the desorbed crystal phase controlling agent is preferably removed from the emulsion by water-washing. Washing can be performed at the temperature not solidifying the gelatin generally used as protective colloid. Various well-known washing methods can be used, e.g., a flocculation method and an ultrafiltration method. The washing temperature is preferably 40° C. or more.

The desorption of the crystal phase controlling agent from the grains is accelerated at low pH. Accordingly, the possible low pH is preferred in the washing step so long as the grains do not agglomerate excessively.

The silver halide grains according to the present invention can contain alone or in combination of ions or complex ions of the metals selected from the metals belonging to Group VIII of the Periodic Table, e.g., osmium, iridium, rhodium, platinum, ruthenium, palladium, cobalt, nickel and iron. These metals may be used in plurality.

The silver halide emulsion according to the present invention can contain the above-described ion-donating compounds by means of adding to an aqueous gelatin solution as the dispersion medium for silver halide grain formation, an aqueous halide solution, an aqueous silver salt solution, or other aqueous solutions, or adding to the silver halide emulsion in the form of silver halide fine grains containing the metal ions in advance, and dissolving this emulsion. Further, the metal ions may be incorporated into the silver halide fine grains at any stage of before, during and just after grain formation, and the addition time can be varied in dependence on to where of the grains and how much amount the metal ion is to be incorporated.

It is preferred that 50 mol % or more, preferably 80 mol % or more, and more preferably 100 mol %, of the metal ion-donating compound to be used be localized at the surface layer corresponding to 50% or less of the grain volume from the surface of the silver halide grains according to the present invention. The volume of the surface layer is preferably 30% or less. The localization of the metal ion on the surface layer is advantageous for inhibiting the increase of interior sensitivity and obtaining high sensitivity. For localizing the metal ion-donating compound on the surface layer of the silver halide grains, for example, after the silver halide grain (core part) exclusive of the surface layer are formed, the metal ion-donating compound is supplied with the addition of an aqueous silver salt solution and an aqueous halide solution for forming the surface layer.

Besides the metals belonging to Group VIII of the Periodic Table, the silver halide emulsion for use in the present invention can contain various polyvalent metal ion impurities during the steps of emulsion grain formation or physical ripening. The addition amount of these compounds varies widely according to the purpose but is preferably from $10^{-9}$ to $10^{-2}$ mol per mol of the silver.

The silver halide emulsion for use in the present invention is generally chemically sensitized. As chemical sensitizing methods, a gold sensitizing method using gold compounds (e.g., U.S. Pat. Nos. 2,448,060 and 3,320,069), a sensitizing method using metals such as iridium, platinum, rhodium, palladium, etc. (e.g., U.S. Pat. Nos. 2,448,060, 2,566,245, 2,566,263), a sulfur sensitizing method using sulfur-containing compounds (e.g., U.S. Pat. No. 2,222,264), a selenium sensitizing method using selenium compounds, a tellurium sensitizing method using tellurium compounds, or a reduction sensitizing method using tin salts, thiourea dioxide, polyamine, etc. (e.g., U.S. Pat. Nos. 2,487,850, 2,518,698, 2,521,925) can be used alone or in combination of two or more.

The silver halide emulsions for use in the present invention are preferably emulsions which are subjected to gold sensitization known in the industry. By effecting gold sensitization, the fluctuation in photographic properties at the time when scanning exposure by a laser beam, etc., is conducted can be reduced to a smaller degree. Compounds such as chloroauric acid or salts thereof, gold thiocyanates or gold thiosulfates can be used for gold sensitization. The addition amount of these compounds is varied depending on cases but is generally from $5\times10^{-7}$ to $5\times10^{-2}$ mol, preferably from $1\times10^{-6}$ to $1\times10^{-3}$ mol, per mol of the silver halide. These compounds are added until the termination of chemical sensitization.

In the present invention, gold sensitization is preferably conducted in combination with other sensitization methods such as sulfur sensitization, selenium sensitization, tellurium sensitization, reduction sensitization or noble metal sensitization using noble metals other than gold.

The silver halide emulsions for use in the present invention can contain a variety of compounds or their precursors for the purpose of preventing fog or stabilizing photographic properties during manufacturing process, storage or photographic processing of the photographic materials. Specific examples of these compounds which are preferably used are disclosed in JP-A-62-215272, pp. 37 to 72. The emulsions for use in the present invention are preferably the so-called surface latent image type emulsions wherein a latent image is primarily formed on the surface of a grain.

Other well-known photographic substances and additives can be used in the silver halide photographic material according to the present invention.

For example, a transmitting type support and a reflective type support can be used as a photographic support in the present invention. As the transmitting type support, a transparent film such as a cellulose nitrate film and a polyethylene terephthalate film, and polyester of 2,6-naphthalenedicarboxylic acid (NDCA) and ethylene glycol (EG), polyester of NDCA, terephthalic acid and EG having an data recording layer such as a magnetic recording layer are preferably used. As the reflective type support, a reflective support, which is laminated with a plurality of polyethylene layers and polyester layers and in which at least one of such water resistant resin layers (laminate layers) contains a white pigment, e.g., titanium oxide, is preferred.

Further, a brightening agent is preferably contained in the above water resistant resin layers. A brightening agent may be dispersed in a hydrophilic colloid layer of the photographic material. Preferred brightening agents are benzoxazole-based, coumalin-based, and pyrazoline-based brightening agents, and more preferred are benzoxazolylnaphthalene-based and benzoxazolylstilbene-based brightening agents. The addition amount is not particularly limited but is preferably from 1 to 100 mg/$m^2$. The mixing ratio when they are mixed with a water resistant resin is preferably from 0.0005 to 3 wt %, more preferably from 0.001 to 0.5 wt %, to the resin.

A transmitting type support and the above-described reflective type support coated with a hydrophilic colloid layer containing a white pigment may also be used as the reflective type support.

A reflective type support having a mirror reflective or second kind diffuse reflective metal surface may also be used.

Preferred examples of reflective type supports, silver halide emulsions, kinds of foreign metal ions which are doped in silver halide grains, storage stabilizers and antifoggants for silver halide emulsions, chemical sensitization methods sensitizers) spectral sensitization methods (spectral (sensitizers), cyan, magenta and yellow couplers which can be used in combination and emulsifying dispersion methods thereof, color image storing improvers (antistaining agents and discoloration inhibitors), dyes (coloring layers), kinds of gelatins, layer connstitutions and pH of coated films of photographic materials are disclosed in the patents described in the following Tables 1 and 2, and they are preferably applied to the present invention.

TABLE 1

| Photographic Constitutional Element | JP-A-7-104448 | JP-A-7-77775 | JP-A-7-301895 |
|---|---|---|---|
| Reflective type support | 1. 12, column 7 to 1. 19, column 12 | 1. 43, column 35 to 1. 1, column 44 | 1. 40, column 5 to 1. 26, column 9 |
| Silver halide emulsion | 1. 29, column 72 to 1. 18, column 74 | 1. 36, column 44 to 1. 29, column 46 | 1. 48, column 77 to 1. 28, column 80 |
| Kind of foreign ion | 1. 19, column 74 to 1. 44, the same column | 1. 30, column 46 to 1. 5, column 47 | 1. 29, column 80 to 1. 6, column 81 |
| Storage stabilizer and antifoggant | 1. 9, column 75 to 1. 18, the same column | 1. 20, column 47 to 1. 29, the same column | 1. 11, column 18 to 1. 37, column 31 (in particular, mercapto heterocyclic compound) |
| Chemical sensitizing method (chemical sensitizer) | 1. 45, column 74 to 1. 6, column 75 | 1. 7, column 47 to 1. 17, the same column | 1. 9, column 81 to 1. 17, the same column |

TABLE 1-continued

| Photographic Constitutional Element | JP-A-7-104448 | JP-A-7-77775 | JP-A-7-301895 |
|---|---|---|---|
| Spectral sensitizing method (spectral sensitizer) | 1. 19, column 75 to 1. 45, column 76 | 1. 30, column 47 to 1. 6, column 49 | 1. 21, column 81 to 1. 48, column 82 |
| Cyan coupler | 1. 20, column 12 to 1. 49, column 39 | 1. 50, column 62 to 1. 16, column 63 | 1. 49, column 88 to 1. 16, column 89 |
| Yellow coupler | 1. 40, column 87 to 1. 3, column 88 | 1. 17, column 63 to 1. 30, the same column | 1. 17, column 89 to 1. 30, the same column |
| Magenta coupler | 1. 4, column 88 to 1. 18, the same column | 1. 31, column 63 to 1. 11, column 64 | 1. 34, column 32 to 1. 44, column 77; 1. 32, column 89 to 1. 46, the same column |
| Emulsifying dispersion method of coupler | 1. 3, column 71 to 1. 11, column 72 | 1. 36, column 61 to 1. 49, the same column | 1. 35, column 87 to 1. 48, the same column |

TABLE 2

| Photographic Constitutional Element | JP-A-7-104448 | JP-A-7-77775 | JP-A-7-301895 |
|---|---|---|---|
| Color image storing improver (antistaining agent) | 1. 50, column 39 to 1. 9, column 70 | 1. 50, column 61 to 1. 49, column 62 | 1. 49, column 87 to 1. 48, column 88 |
| Discoloration inhibitor | 1. 10, column 70 to 1. 2, column 71 | — | — |
| Dye (coloring layer) | 1. 42, column 77 to 1. 41, column 78 | 1. 14, column 7 to 1. 42, column 19; 1. 3, column 50 to 1. 14, column 51 | 1. 27, column 9 to 1. 10, column 18 |
| Kind of gelatin | 1. 42, column 78 to 1. 48, the same column | 1. 15, column 51 to 1. 20, the same column | 1. 13, column 83 to 1. 19, the same column |
| Layer constitution of photographic material | 1. 11, column 39 to 1. 26, the same column | 1. 2, column 44 to 1. 35, the same column | 1. 38, column 31 to 1. 33, column 32 |
| pH of coated film of photographic material | 1. 12, column 72 to 1. 28, the same column | — | — |
| Scanning exposure | 1. 6, column 76 to 1. 41, column 77 | 1. 7, column 49 to 1. 2, column 50 | 1. 49, column 82 to 1. 12, column 83 |
| Preservative in developing solution | 1. 19, column 88 to 1. 22, column 89 | — | — |

In addition to those described in Tables 1 and 2, cyan, magenta and yellow couplers disclosed in JP-A-62-215272, line 4, right upper column, page 91 to line 6, left upper column, page 121; JP-A-2-33144, line 14, right upper column, page 3 to the last line, left upper column, page 18; JP-A-2-33144, line 6, right upper column, page 30. to line 11, right lower column, page 35; EP-A-355660, lines 15 to 27, page 4; line 30, page 5 to the last line, page 28; lines 29 to 31, page 45; and line 23, page 47 to line 50, page 63; JP-A-8-122984 and JP-A-9-222704 can also be used in the present invention.

Well-known color mixing preventives can be used in the present invention, and those disclosed in the following patents are particularly preferred.

For example, the high molecular weight redox compounds disclosed in JP-A-5-333501, the phenidone and hydrazine compounds disclosed in JP-A-10-833760 and U.S. Pat. No. 4,923,787, and the white couplers disclosed in JP-A-5-249637, JP-A-10-282615 and German Patent 19629142A1 can be used. Further, when rapid development is performed with increasing pH of a developing solution, the redox compounds disclosed in German Patent 19618786A1, EP-A-839623, EP-A-842975, German Patent 19806846A1 and French Patent 276046A1 are also preferably used.

It is preferred in the present invention to use a compound having a triazine skeleton having a high molar extinction coefficient as an ultraviolet absorber. For example, the following compounds can be used.

The compounds disclosed in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent 19739797A, EP-A-711804 and JP-W-8-501291 can be used.

Fungicides and biocides disclosed in JP-A-63-271247 are useful for the present invention. Gelatin is preferably used as the hydrophilic colloid for use in the photographic layers constituting the photographic material, and the content of heavy metals such as iron, copper, zinc, manganese which are contained as impurities is preferably 5 ppm or less, more preferably 3 ppm or less.

The amount of calcium contained in the photographic material is preferably 20 mg/m$^2$ or less, more preferably 10 mg/m$^2$ or less, and most preferably 5 mg/m$^2$ or less.

The photographic material of the present invention is also suitably used, in addition to the current exposure type printing system using a general negative printer, in a scanning exposure system using a cathode ray tube (CRT) and laser beams.

A cathode ray tube exposure apparatus is simple and compact as compared with the apparatuses using laser beams, costs can be saved and the adjustment of optical axis and color is easy.

Various emitters showing emission to spectral regions according to necessity are used in a cathode ray tube for use for image exposure. For example, any one of red emitter, green emitter and blue emitter, or mixture of two or more of these are used. Spectral regions are not limited to the above red, green and blue, and phosphors emitting lights in yellow, orange, violet and infrared regions are also used. A cathode ray tube which emits white light by mixing these emitters is often used.

When the photographic material has a plurality of photosensitive layers having different spectral sensitivity distribution and the cathode ray tube also has phosphors emitting lights in a plurality of spectral regions, a plurality of colors may be exposed at the same time, i.e., image signals of a plurality of colors may be inputted to the cathode ray tube and emitted. Alternatively, an exposure method comprising inputting an image signal of each color in order and emitting light of each color in order through a filter cutting other colors except for that color [sequential face exposure (i.e., a print exposure system using an image controlling method called "digital light processing system (DLP system))] may be adopted. In general, sequential face exposure is preferred for obtaining a high quality image because a cathode ray tube having high resolving power can be used.

The photographic material of the present invention can be used in a digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum wavelength of the photographic material of the present invention can be set arbitrarily according to the wavelength of the scanning exposure light source to be used. As oscillation wavelength of a laser can be made half using an SHG light source comprising a combination of nonlinear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red.

The exposure time in such a scanning exposure is defined as the time necessary to expose a pixel size with the pixel density being 400 dpi, and preferred exposure time is $10^{-4}$ sec or less and more preferably $10^{-6}$ sec or less.

Preferred scanning exposure systems which can be applied to the present invention are disclosed in detail in the patents described in the above table.

For processing the photographic material according to the present invention, processing substances and processing methods disclosed in JP-A-2-207250, line 1, right lower column, page 26 to line 9, right upper column, page 34; and JP-A-4-97355, line 17, left upper column, page 5 to line 20, right lower column, page 18 can be preferably used. Further, as preservatives for use in these developing solutions, compounds disclosed in the patents described in the above table can preferably be used.

Factors concerning development processing, processing steps, processing agents and processing apparatuses selected with the factors of photographic materials for exhibiting the conditions satisfying at least equation (R-1) described above will be explained.

A developing solution and a developing replenisher contain a color developing agent, and preferred examples are well-known aromatic primary amine color developing agents, in particular, p-phenylenediamine derivatives. Representative examples thereof are shown below, but the present invention is not limited thereto.

1) N,N-Diethyl-p-phenylenediamine
2) 4-Amino-N,N-diethyl-3-methylaniline
3) 4-Amino-N-(β-hydroxyethyl)-N-methylaniline
4) 4-Amino-N-ethyl-N-(β-hydroxyethyl)aniline
5) 4-Amino-N-ethyl-N-(β-hydroxyethyl)-3-methylaniline
6) 4-Amino-N-ethyl-N-(3-hydroxypropyl)-3-methylaniline
7) 4-Amino-N-ethyl-N-(4-hydroxybutyl)-3-methylaniline
8) 4-Amino-N-ethyl-N-(β-methanesulfonamidoethyl)-3-methylaniline
9) 4-Amino-N, N-diethyl-3-(β-hydroxyethyl)aniline
10) 4-Amino-N-ethyl-N-(β-methoxyethyl)-3-methylaniline
11) 4-Amino-N-(β-ethoxyethyl)-N-ethyl-3-methylaniline
12) 4-Amino-N-(3-carbamoylpropyl)-N-n-propyl-3-methylaniline
13) 4-Amino-N-(4-carbamoylbutyl)-N-n-propyl-3-methylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidinecarboxamide Of the above p-phenylenediamine derivatives, preferred are Compounds 5), 6), 7), 8) and 12), and Compounds 5) and 8) are particularly preferred. These p-phenylenediamine derivatives are generally in the form of salts such as sulfate, hydrochloride, sulfite, naphthalenedisulfonate, p-toluenesulfonate when they are supplied as solid materials. The concentration of the aromatic primary amine color developing agent in a developing solution or a developing replenisher is preferably from 2 to 200 mmol, more preferably from 12 to 200 mmol, and still more preferably from 12 to 150 mmol, per liter. The concentration of a replenisher is designed to be higher than that of a developing solution considering the amount to be consumed by development, and the concentration of a replenisher is determined so that the concentration in a developing tank is maintained constant by balancing the amount to be replenished to a developing tank, the amount to be consumed by development, and the amount to be lost by the carryover to the next tank and overflow. Accordingly, in the case of low replenishment processing, which is a preferred embodiment of the present invention, the concentration of a developing agent is set up high to secure the necessary supply amount with less replenishing amount.

In the development processing method of the present invention, the developing solution contains a small amount of sulfite ion in some case according to the objective photographic material, or does not substantially contain in another case. This is because a sulfite ion sometimes adversely affects photographic characteristics during color developing process according to the objective photographic materials, although it has conspicuous preservative property.

Hydroxylamine is also contained in the constitutional component of the composition or not contained according to the kind of materials to be used, because hydroxylamine sometimes affects photographic characteristics since it has development activity concurrently with the function as a preservative.

It is preferred for the color developing solution according to the present invention to contain inorganic preservatives such as the above hydroxylamine and a sulfite ion and organic preservatives. Organic preservatives used herein means general organic compounds which reduce the deterioration speed of the aromatic primary amine color developing agent when added to the processing solution of a photographic material. That is, organic preservatives herein means organic compounds which have functions to prevent the air oxidation of color developing agents and, above all, hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring amines are particularly effective organic preservatives. These organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020, and JP-B-48-30496 (the term "JP-B" as used herein means an "examined Japanese patent publication").

In addition, the various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349, and the aromatic polyhydroxyl compounds disclosed in U.S. Pat. No. 3,746,544 may be used as preservatives, if necessary. Of these compounds, the alkanolamines are effective to improve the aging stability of the developing solution and developing replenisher themselves and the concentrated composition for supplying these solutions.

Examples of alkanolamines effective for improving aging stability include triisopropanolamine, diisopropanolamine, monoisopropanolamine, and diethanolamine, and triisopropanolamine is particularly preferred. Besides these, triethanolamines can also be preferably used.

The addition amount of the above alkanolamines is from 0.01 to 1 mol, preferably from 0.02 to 0.2 mol, per liter of the processing solution.

In addition, dihydroxylamine derivatives, e.g., substituted or unsubstituted dialkylhydroxylamine such as disulfoethylhydroxylamine and diethylhydroxylamine or aromatic polyhydroxyl compounds can also be preferably used.

Of the above organic preservatives, hydroxylamine derivatives are particularly preferably used, and details thereof are disclosed in JP-A-1-97953, JP-A-1-186939, JP-A-1-186940, and JP-A-1-187557. The combined use of hydroxylamine derivatives with amines is particularly preferred from the point of the improvement of stability of the color developing agent and the improvement of stability at continuous processing.

As examples of other amines, the cyclic amines as disclosed in JP-A-63-239447, the amines as disclosed in JP-A-63-128340, and the amines as disclosed in JP-A-1-186939 and JP-A-1-187557 can be exemplified.

Chlorine ions may be added to a developing solution, if necessary. In many cases, a color developing solution (in particular, a color developing solution for color print materials) generally contains chlorine ions in an amount of from $3.5\times10^{-2}$ to $1.5\times10^{-1}$ mol/liter, but since chlorine ions are released into a developing solution as the by-product of development, the addition to a replenisher is not necessary in many cases. The amount of the chlorine ion in a replenisher is set up so that the chlorine ion concentration in a developing tank of the time when reached running equilibrium composition becomes the above-described level of concentration. When the concentration of the chlorine ion is more than $1.5\times10^{-1}$ mol/liter, the development is delayed, which is disadvantageous as rapid development property and color density are impaired. If the concentration is less than $3.5\times10^{-2}$ mol/liter, it is not preferred in many cases for preventing fog.

With respect to the addition of bromine ions, the situation is the same as the case of chlorine ions. The concentration of bromine ions in a color developing solution is preferably from 1 to $5\times10^{-3}$ mol/liter or so for materials for photographing and $1.0\times10^{-3}$ mol/liter or less for materials for printing. Bromine ions may be added to a developing replenisher according to necessity so as to reach the above bromine ion concentration range.

For adding chlorine ions to a developing solution, and if necessary to a replenisher, sodium chloride, potassium chloride, ammonium chloride, lithium chloride, nickel chloride, magnesium chloride, manganese chloride, and calcium chloride can be exemplified as chlorine ion supplying substances. Sodium chloride and potassium chloride are preferred of these.

As bromine ion supplying substances, sodium bromide, potassium bromide, ammonium bromide, lithium bromide, calcium bromide, magnesium bromide, manganese bromide, nickel bromide, cerium bromide, and thallium bromide can be exemplified. Potassium bromide and sodium bromide are preferred of these.

When the photographic material to be processed is color paper, since it is an important picture quality that the white background of the picture plane is white, stilbene-based brightening agents, in particular, di(triazylamino)stilbene based and 4,4'-diamino-2,2'-diaminodisulfostilbene based brightening agents, are sometimes added to a color developing solution.

The stilbene-based brightening agents may be added to a desilvering solution or a photographic material as well as a color developing solution, and when added to a color developing solution, the concentration is preferably from $1\times10^{-4}$ to $5\times10^{-2}$ mol/liter, more preferably from $2\times10^{-4}$ to $1\times10^{-2}$ mol/liter. The addition amount of the composition of the processing agent of the present invention is determined so that the working developing solution contains the brightening agent in this concentration.

The color developing solution or the replenisher according to the present invention has pH of from 9.5 to 13.0, more preferably from 9.8 to 12.5. The use of various buffers is preferred for maintaining the above pH level. Examples of buffers which can be used include potassium carbonate, sodium carbonate, carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Carbonates, phosphates, tetraborates and hydroxybenzoates are particularly excellent in buffering ability in a high pH range of pH 9.0 or more, and do not adversely affect photographic properties (such as to cause fogging) when added to a color developing solution and inexpensive, therefore, the use of these buffers is particularly preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited thereto.

The concentration of buffers in the color developing replenisher of the present invention is preferably from 0.04 to 2.0 mol/liter, particularly preferably from 0.1 to 0.4 mol/liter, in total of buffers.

Various chelating agents can be used in the color developing solution of the present invention for preventing the precipitation of other developing solution components, e.g., calcium and magnesium, or improving the stability of the color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, ethylenediamine-N,N-disuccinic acid, N,N-di(carboxylato)-L-aspartic acid, β-alaninedisuccinic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)-ethylenediamine-N,N'-diacetic acid, and 1,2-dihydroxybenzene-4,6-disulfonic acid.

These chelating agents may be used in combination of two or more, if required.

The addition amount of these chelating agents should be sufficient to enclose metal ions in the color developing solution, and the amount is, for example, about 0.1 g to 10 g per liter.

The color developing solution can contain a development accelerator, if desired.

For example, the thioether-based compounds disclosed in JP-B-37-16088, JP-B-37-5987, JP-B-38-7826, JP-B-44-12380, JP-B-45-9019 and U.S. Pat. No. 3,813,247, the p-phenylenediamine-based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine-based compounds disclosed in U.S. Pat. Nos. 2,494,903, 3,128,182, 4,230,796, 3,253,919, JP-B-41-11431, U.S. Pat. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator, if necessary.

An antifoggant can be included arbitrarily in the present invention, if desired. Alkali metal halides such as sodium chloride, potassium bromide and potassium iodide, and organic antifoggants can be used as an antifoggant. Specific examples of organic antifoggants include nitrogen-containing heterocyclic compounds such as benzotriazole, 6-nitrobenzimidazole, 5-nitroisoindazole, 5-methylbenzotriazole, 5 -nitrobenzotriazole, 5-chlorobenzotriazole, 2-thiazolylbenzimidazole, 2-thiazolylmethylbenzimidazole, indazole, hydroxyazaindolizine and adenine.

Besides the surfactants according to the present invention, various surfactants can be used if required, e.g., alkylsulfonic acid, arylsulfonic acid, aliphatic carboxylic acid, and aromatic carboxylic acid can be used.

The color developing replenisher and color developing solution for use in the present invention are as described above.

The color development processing temperature in the present invention is from 30 to 55° C., preferably from 35 to 55° C., and more preferably from 38 to 53° C., when the photographic material is a color print material. The development processing time is from5 to 90 seconds, preferably from 8 to 60 seconds, in particular, the present invention is suitable for extremely rapid development of from 10 to 30 seconds as described above. The replenishing rate is preferably less, but is generally appropriately from 20 to 600 ml, preferably from 30 to 120 ml, and particularly preferably from 15 to 60 ml, per m2 of the photographic material.

On the other hand, when the photographic material is a color negative film or a color reversal film, the color development processing temperature is from 20 to 55° C., preferably from 30 to 55° C., and more preferably from 38 to 45° C., and the development processing time is from 10 seconds to 6 minutes. The replenishing rate is preferably less, but is generally appropriately from 20 to 500 ml, preferably from 30 to 200 ml, and particularly preferably from 50 to 160 ml, per $m^2$ of the photographic material.

In the present invention, the development step by a color developing solution is followed by the desilvering step, where the processing with a bleaching solution and a blixing solution is performed. When the photographic material is a color print material, the processing solution may also contain the above-described appropriate brightening agents, preferably stilbene-based brightening agents.

As the bleaching agents for use in a bleaching or blixing solution, well-known bleaching agents can be used, in particular, organic complex salts of iron(III) (e.g., complex salts of aminopolycarboxylic acids), or organic acids such as citric acid, tartaric acid, malic acid, persulfate, and hydrogen peroxide are preferably used.

Of these compounds, organic complex salts of iron(III) are particularly preferred from the viewpoint of rapid processing and environmental protection. Examples of aminopolycarboxylic acids and salts thereof useful for forming organic complex salts of iron(III) include biodegradable ethylenediaminedisuccinic acid (SS body), N-(2-carboxylatoethyl)-L-aspartic acid, β-alaninediacetic acid, methyliminodiacetic acid, in addition, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid, glycol ether diaminetetraacetic acid, and the compound represented by formula (I) or (II) disclosed in EP 0789275 can be exemplified. These compounds maybe any form of sodium salts, potassium salts, lithium salts and ammonium salts. Of these compounds, ethylenediaminedisuccinic acid (SS body), N-(2-carboxylatoethyl)-L-aspartic acid, β-alaninediacetic acid, ethylenediaminetetraaceticacid, 1,3-diaminopropanetetraacetic acid, and methyliminodiacetic acid are preferred because iron(III) complex salts thereof are excellent in photographic characteristics. These ferric ion complex salts may be used in the form of complex salt, or ferric ion complex saltsmaybe formed in a solution using ferric salts, e.g., ferric sulfate, ferric chloride, ferric nitrate, ferric ammonium sulfate and ferric phosphate with a chelating agent such as aminopolycarboxylic acid. A chelating agent may be used in the excess amount more than the amount for forming ferric ion complex salt. Of the iron complexes, aminopolycarboxylic acid iron complex is preferred, and the addition amount thereof is from 0.01 to 1.0 mol/liter, preferably from 0.05 to 0.50 mol/liter, still more preferably from 0.10 to 0.50 mol/liter, and most preferably from 0.15 to 0.40 mol/liter.

The bleaching time is generally from 10 seconds to 6 minutes and 30 seconds, preferably from 15 seconds to 2 minutes.

Various well-known fixing agents are used in the blixing solution or the fixing solution of the present invention. Examples include thiosulfates such as sodium thiosulfate and ammonium thiosulfate, thiocyanates such as sodium thiocyanate, ammonium thiocyanate, thioether compounds such as ethylenebisthioglycolic acid and 3, 6-dithia-1,8-octanediol, and water-soluble silver halide solvents such as thioureas. These compounds can be used alone or in combination of two or more. Further, the specific blixing solution comprising combination of a fixing agent and halides such as a great amount of potassium iodide as disclosed in JP-A-55-155354 can also be used in the present invention. Thiosulfate, in particular, ammonium thiosulfate, is particularly preferably used in the present invention. The amount of a fixing agent is preferably from 0.3 to 2 mol, more preferably from 0.5 to 1.0 mol, per liter of the solution.

The blixing solution or fixing solution for use in the present invention preferably has pH of from 3 to 8, more preferably from 4 to 7. When the pH is lower than this range, the solution is deteriorated and cyan dyes becomes leuco dyes accelerately, although desilvering property is improved. While when the pH is higher than this range, desilvering is delayed and stains are liable to occur.

The bleaching solution for use in the present invention has pH of 8 or less, preferably from 2 to 7, and particularly preferably from 2 to 6. When the pH is lower than this range, the solution is deteriorated and cyan dyes becomes leuco dyes accelerately, while when the pH is higher than this range, desilvering is delayed and stains are liable to occur.

For adjusting pH, if necessary, hydrochloric acid, sulfuric acid, nitric acid, bicarbonate, ammonia, potassium hydroxide, sodium hydroxide, sodium carbonate, and potassium carbonate can be added to the solution.

Further, the blixing solution of the present invention can contain other various kinds of brightening agents, defoaming agents and surfactants, and organic solvents such as polyvinylpyrrolidone and methanol.

It is preferred that the blixing solution and fixing solution of the present invention contain, as a preservative, sulfite ion-releasing compounds such as sulfite (e.g., sodium sulfite, potassium sulfite, ammonium sulfite, etc.), bisulfite (e.g., ammoniumbisulfite, sodiumbisulfite, potassiumbisulfite, etc.), metabisulfite (e.g., potassium metabisulfite, sodium metabisulfite, ammonium metabisulfite, etc.), and arylsulfinic acid such as p-toluenesulfinic acid and m-carboxybenzenesulfinic acid. The content of these compounds is preferably from about 0.02 to about 1.0 mol/liter in terms of a sulfite ion or sulfinic acid ion.

In addition to the above compounds, ascorbic acid, bisulfite adducts of carbonyl and carbonyl compounds can be used.

Further, a buffer, a brightening agent, a chelating agent, a defoaming agent, and an antimold can be used, if necessary.

The blixing processing time according to the present invention is from5 to 240 seconds, preferably from 10 to 60 seconds, and the processing temperature is from 25 to 60° C., preferably from 30 to 50° C. The replenishing rate is from 20 to 250 ml, preferably from 30 to 100 ml, and particularly preferably from 15 to 60 ml, per $m^2$ of the photographic material.

The photographic material of the present invention is generally subjected to washing step and/or stabilizing step after desilvering step such as fixing or blixing.

The amount of washing water in the washing step can be selected from a wide range according to the characteristics and the application of the photographic materials (for example, the materials used such as couplers, etc.), the temperature of washing water, the number of washing tanks (the number of washing stages), and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pp. 248 to 253 (May, 1955). The number of stages in a multistage countercurrent system is generally preferably from 3 to 15, particularly preferably from 3 to 10.

According to the multistage countercurrent system, the amount of the washing water can be greatly reduced, however, problems arise that bacteria proliferate due to the increased residence time of the water in the tanks, and suspended matters produced thereby adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine-based antibacterial agents such as chlorinated sodium isocyanurate, the benzotriazole and copper ions as disclosed in JP-A-61-267761, and the antibacterial agents described in Hiroshi Horiguchi, *Bohkin Bohbai no Kagaku* (*Antibacterial and Antifungal Chemistry*), published by Sankyo Shuppan K.K. (1986), *Biseibutsu no Mekkin. Sakkin. Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986), can be used.

Further, aldehydes such as formaldehyde, acetaldehyde and pyruvic aldehyde which inactivate the residual magenta couplers and prevent the discoloration of the dyes, the methylol compounds and hexamethylenetetramine disclosed in U.S. Pat. No. 4,786,583, the hexahydrotriazine disclosed in JP-A-2-153348, the bisulfite adducts of formaldehyde disclosed in U.S. Pat. No. 4,921,779, and the azolylmethylamines disclosed in EP 504609 and EP 519190 are added to the processing solution.

A surfactant as a dewatering agent and a chelating agent represented by EDTA as a hard water softener can further be added to washing water.

The photographic material of the present invention is subjected to stabilizing step after washing step, or can be processed directly with a stabilizing solution without employing the washing step as described above. A stabilizing solution contains a compound having an image stabilizing function, e.g., aldehyde compounds represented by formalin, a buffer for adjusting film pH suitable for dye stabilization, and an ammonium compound. For preventing bacteria from proliferating in a stabilizing solution and for imparting antimold property to a processed photographic material, the above-described various kinds of antibacterial agents and sterilizers can be used.

Further, a surfactant, a brightening agent and a hardening agent can further be added to a stabilizing solution. In the process of the photographic material of the present invention, when the photographic material is directly processed with a stabilizing solution without subjecting to the washing step, any of the well-known methods disclosed in JP-A-57-8543, JP-A-58-14834 and JP-A-60-220345 can be used.

In addition, a chelating agent such as 1-hydroxyethylidene-1,1-diphosphonic acid and ethylenediaminetetramethylenephosphonic acid, and magnesium compounds and bismuth compounds are also preferably used.

A rinsing solution is also preferably used as the washing solution or stabilizing solution which is used after desilvering process.

The pH of the water washing step and stabilizing step is preferably from 4 to 10, more preferably from 5 to 8. The temperature can be set up according to various uses and characteristics of the photographic material but is generally from 20 to 50° C., preferably from 25 to 45° C.

Drying step is performed following washing and/or stabilizing step(s). It is possible to expedite drying by absorbing water of the material fresh from the washing tank by means of a squeegee and cloth from the viewpoint of reducing the carryover of water to the image film. As the improving means from the drier side, although it is a matter of course, drying can be expedited by increasing temperature and modulating the shape of nozzles to strengthen the dry air. Further, as is disclosed in JP-A-3-157650, the adjustment of the angle of air blowing and discharging method of the exhaust air are also effective to speed up drying.

The processing of the present invention is carried out with an automatic processor. Automatic processors which are preferably used in the present invention are described below.

It is preferred in the present invention that the linear velocity of the conveyance of the automatic processor is preferably 5,000 mm/min or less, more preferably from 200 to 4,500 mm/min, and particularly preferably from 500 to 3,000 mm/min.

It is preferred that the contact area of air with the processing solution in a processing tank and a replenisher tank (open area) of the present invention is as small as possible. For example, when the open factor is represented by the equation dividing the open area ($cm^2$) by the volume of the processing solution in the tank ($cm^3$), the open factor is preferably 0.01 ($cm^{-1}$) or less, more preferably 0.005 or less, and particularly preferably 0.001 or less.

It is preferred to provide a solid or liquid non-contact means with air which is floating on the surface of the solution in a processing tank or a replenisher tank to reduce the open area.

Specifically, means of covering the surface of the solution with a floating lid of plastics or shielding with a liquid immiscible with and not chemically reacting with a processing solution are preferred. Liquid paraffin and liquid saturated hydrocarbon are preferred as examples of such liquids.

The crossover time required for a photographic material to transfer from one processing tank to another processing tank in the air is preferred to be as short as possible for carrying out processing rapidly, preferably 10 seconds or less, more preferably 7 seconds or less, and most preferably 5 seconds or less. The use of a cinema type automatic processor is preferred in the present invention for achieving such a short crossover time, in particular, a leader conveyance system is preferred. Such a system is adopted in an automatic processor FP-560B, a product of Fuji Photo Film Co., Ltd.

A belt conveyor system disclosed in JP-A-60-191257, JP-A-60-191258 and JP-A-60-191259 is preferred as a conveying system of a leader or a photographic material, in particular, the systems disclosed in JP-A-3-126944, JP-A-3-127062 and JP-A-3-127061 are preferably adopted as conveyor structures.

The structure of a crossover rack which is provided with a mixture inhibiting plate disclosed in JP-A-3-126943 is preferred for use in the present invention for shortening the crossover time and inhibiting the mixture of the processing solutions.

It is preferred in the present invention that the amounts corresponding to the evaporated processing solutions be supplemented with water, that is, a so-called evaporation compensation, and it is particularly preferred with regard to a color developing solution, a bleaching solution and a blixing solution.

There is no particular limitation on the method of supplementing water, but the following methods are preferred above all, e.g., a method in which a monitoring water tank is arranged separately from the bleaching tank, and the amount of water evaporated from the bleaching tank is calculated from the amount of water evaporated from the monitoring water tank, and water is replenished to the bleaching tank in proportion to this amount of evaporation, which is disclosed in JP-A-1-254959 and JP-A-1-254960, and a method in which a liquid level sensor or an overflow sensor is used to compensate for the evaporated amount of water, which is disclosed in JP-A-3-248155, JP-A-3-249644, JP-A-3-249645, JP-A-3-249646 and JP-A-4-14042. The most preferred evaporation compensation method is a method in which the presumed amount of water corresponding to the evaporation amount calculated from the coefficient determined in advance based on the data of operating time, stopping time and temperature controlling time of the automatic processor is added, which is disclosed in *Nippon Hatsumei Kyokai Kokai Giho,* 94-49925, line 26, right column, page 1 to line 28, left column, page 3, and Japanese Patent Application No. 2-103894.

Further, means to reduce the evaporation amount are necessary, for example, reducing the open area or controlling the air capacity of an exhaust fan are required. As the preferred open factor of a color developing solution is as described above, it is preferred to reduce open areas with respect to other processing solutions as well.

As a means to decrease the evaporation amount, "maintaining the humidity of the upper space of the processing tank at 80% RH or more" as disclosed in JP-A-6-110171 is particularly preferred, and it is preferred to be provided with the automatic washer for the evaporation preventing racks and rollers illustrated in FIGS. 1 and 2 of the above patent.

An exhaust fan is provided for preventing the dew condensation during temperature controlling, and the preferred displacement is from 0.1 $m^3$ to 1 $m^3$, particularly preferably from 0.2 $m^3$ to 0.4 $m^3$, per minute.

Drying conditions of photographic materials also affect the evaporation of processing solutions. The use of a hot air heater made of ceramic is a preferred drying system, and the supplying air capacity is preferably from 4 $m^3$ to 20 $m^3$, and particularly preferably from 6 $m^3$ to 10 $m^3$, per minute.

A superheating preventing thermostat of a hot air heater made of ceramic is preferably a system actuated by heat transfer and is preferably installed on the leeward side or on the windward side through the radiation fin or the heat transfer part. Drying temperature is preferred to be controlled according to the water content of the photographic material to be processed, and optimal temperature ranges are from 45 to 55° C. in the case of a 35 mm width film and from 55 to 65° C. in the case of a Brownie film.

As a replenishing pump is used in the replenishment of processing solutions, a bellows type replenishing pump is preferred. As a method of improving the accuracy of replenishment, making the diameter of a liquid pipe to a replenishing nozzle smaller is effective to prevent the backflow at stopping time. The inside diameter is preferably from 1 to 8 mm, and particularly preferably from 2 to 5 mm.

There are used various materials of parts in an automatic processor, and preferred materials are described below.

Modified PPO (modified polyphenylene oxide) and modified PPE (modified polyphenylene ether) resins are preferred as materials of tanks such as a processing tank and a temperature controlling tank. An example of modified PPO includes "Noryl" (manufactured by Nippon G.E. Plastics), and examples of modified PPE include "Zailon" (manufactured by Asahi Chemical Industry Co., Ltd.) and "Yupiace" (manufactured by Mitsubishi Gas Chemical Co., Inc. Further, these materials are suitable for parts which might contact with processing solutions, such as a processing rack or a crossover.

PVC (polyvinyl chloride), PP (polypropylene), PE (polyethylene) and TPX (polymethylpentene) resins are suitable as materials for rollers of processing parts. In addition, these materials are usable for other parts which might contact with processing solutions. PE resin is also preferred as a material for a replenisher tank made by blow molding.

PA (polyamide), PBT (polybutylene terephthalate), UHMPE (ultrahigh molecular weight polyethylene), PPS (polyphenylene sulfide), LCP (overall aromatic polyester resin, liquid crystal polymer) resins are preferred as materials for processing parts, gears, sprockets and bearings.

PA resin is a polyamide resin such as 66 nylon, 12 nylon and 6 nylon, and those containing glass fibers and carbon fibers are fast to swelling by processing solutions and usable in the present invention.

A high molecular weight product such as MC nylon and a compression molded product are usable without fiber reinforcement. A UHMPE resin is preferably not reinforced, and preferred and commercially available products thereof include "Lubmer", "Hizex Million" (manufactured by Mitsui Petrochemical Industries, Ltd.), "New Light" (manufactured by Sakushin Kogyo Co., Ltd.), and "Sunfine" (manufactured by Asahi Chemical Industry Co., Ltd.).

The molecular weight is preferably 1,000,000 or more, and more preferably from 1,000,000 to 5,000,000.

The preferred PPS resins are those reinforced with glass fibers or carbon fibers. Examples of commercially available LCP resins include "Victrex" (manufactured by ICI Japan Co., Ltd.), "Ekonol" (manufactured by Sumitomo Chemical Co., Ltd.), "Zaider" (manufactured by Nippon Oil Co., Ltd.), and "Vectra" (manufactured by Polyplastics Co., Ltd.).

Ultrahigh tenacity polyethylene fibers or polyvinylidene fluoride resins described in JP-A-4-151656 are preferred as materials of a conveyor belt.

Vinyl chloride foam resins, silicone foam resins and urethane foam resins are preferred as flexible materials for squeegee rollers and the like. An example of urethane foam resin includes "Lubicel" (manufactured by Toyo Polymer Co., Ltd.).

EPDM rubber, silicone rubber and biton rubber are preferred as rubber materials for couplings of piping, couplings of agitation jet pipe and sealing materials.

Drying time is preferably from 30 seconds to 2 minutes and particularly from 40 seconds to 80 seconds.

Continuous processing primarily by a replenishment system has been described hitherto, however, a batch system in which processing is carried out with a fixed amount of a processing solution without replenishing, subsequently processing is performed again by replacing the entire or a partial processing solution with a new processing solution can also preferably be used in the present invention.

The processing agents which can be used in the present invention may be supplied in the form of one part type or may be supplied in the form of a plural part type concentrated solutions, and they may be powders, tablets, granules or paste. Further, they may be supplied in the state of a working solution, or arbitrary combinations of concentrated solutions, powders, tablets, granules, paste and a working solution.

When the processing agent to be used is one part type concentrated solution, the processing agent is diluted and used as a replenisher. In such a case, it is preferred that the concentrated solution is set in the automatic processor and automatically diluted with water in the replenisher tank. It is preferred that the water to be used for dilution is the water in the washing water replenisher tank. Alternatively, a concentrated solution may be directly supplied to a processing tank as it is and the water corresponding to the diluting rate may be directly added to the processing tank. This method is particularly suitable for a compact processor not having a replenisher tank.

The method is the same with a plural part type concentrated solutions. It is preferred that the concentrated solutions are set in the automatic processor and automatically diluted with water in the replenisher tank. It is preferred that the water to be used for dilution is the water in the washing water replenisher tank. Further, each part of the concentrated solutions may be directly supplied to a processing tank as they are and the water corresponding to the diluting rate may be directly added to the processing tank.

With the case of the processing agents in the form of powders, tablets, granules or paste, the method is also the same. It is preferred that the processing agents are directly added to the processing tank and the water corresponding to the diluting rate may be directly added to the processing tank. Moreover, it is also preferred that they are automatically dissolved and diluted in the replenisher tank and used as a replenisher.

The materials of the replenisher cartridge for use in the present invention may be any of paper, plastics, metals and the like, but plastic materials having an oxygen permeation coefficient of 50 $ml/m^2 \cdot atm \cdot day$ or less are particularly preferred. Further, an oxygen permeation coefficient can be calculated according to the method disclosed in *$Q_2$ Permeation of Plastic Container. Modern Packing,* pp. 143to145, N. J., Calyan (December, 1968).

Specific examples of preferred plastic materials include vinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA), and polyethylene terephthalate (PET).

The use of PVDC, NY, PE, EVA, EVAL and PET is preferred in the present invention for the purpose of reducing oxygen permeability.

These materials may be used alone, and molded or several sheets may be laminated (so-called composite film) . The shape of a vessel may be a bottle type, a cubic type, or a pillow type, but a cubic type or a corresponding structure which is flexible, and handleable and in which the volume can be reduced after use is particularly preferred in the present invention.

When these materials are used in the form of a laminated film, the following structures are particularly preferred but the present invention is not limited thereto. PE/EVAL/PE, PE/aluminum foil/PE, NY/PE/NY, NY/PE/EVAL, PE/NY/PE/EVAL/PE, PE/NY/PE/PE/PE/NY/PE, PE/$SiO_2$ film/PE, PE/PVDC/PE, PE/NY/aluminum foil/PE, PE/PP/aluminum foil/PE, NY/PE/PVDC/NY, NY/EVAL/PE/EVAL/NY, NY/PE/EVAL/NY, NY/PE/PVDC/NY/EVAL/PE, PP/EVAL/PE, PP/EVAL/PP, NY/EVAL/PE, NY/aluminum foil/PE, paper/aluminum foil/PE, paper/PE/aluminum foil/PE, PE/PVDC/NY/PE, NY/PE/aluminum foil/PE, PET/EVAL/PE, PET/aluminum foil/PE, PET/aluminum foil/PET/PE.

The thickness of the above laminated film is from 5 to 1,500 μm or so, and preferably from 10 to 1,000 μm or so. The volume of the finished vessel is from 100 ml to 20 liters or so, and preferably from 500 ml to 10 liters or so.

The above vessel (cartridge) may have a case of corrugated cardboard or plastics or may be molded integrally with the case.

The cartridge of the present invention can be charged with various processing solutions, e.g., a color developing solution, a black-and-white developing solution, a bleaching solution, a compensating solution, a reversal solution, a fixing solution, a blixing solution, and a stabilizing solution. Particularly, a cartridge having a low oxygen permeation coefficient is suitable for containing a color developing solution, a black-and-white developing solution, a fixing solution and a blixing solution.

Conventionally used rigid vessels for processing solutions of a monolayer material such as high density polyethylene (HDPE), polyvinyl chloride resin (PVC), and polyethylene terephthalate (PET) and a multilayer material such as nylon/polyethylene (NY/PE) can be used.

A flexible vessel for processing solutions the volume of which can be reduced after the content is discharged and empty, that is, the required space can be reduced, can also be used.

It is preferred in the present invention to use the above flexible vessel. One specific example of the above flexible vessel is a vessel for a solution comprising a flexible vessel body which is opened and closed by a cap member matching a hard opening part protruding upward from the vessel body, the vessel body and the opening part are integral-molded and at least one part of the vessel body toward the height direction has a bellows part (FIG. 1 and FIG. 2 disclosed in JP-A-7-5670).

EXAMPLE

The present invention is specifically described below with referring to examples, but it should not be construed as the present invention is limited thereto.

In the following description of each example, a blue-sensitive emulsion layer, a green-sensitive emulsion layer and a red-sensitive emulsion layer are respectively called a yellow coupler-containing layer, a magenta coupler-containing layer and a cyan coupler-containing layer, or when after processing a yellow-coloring layer, a magenta-coloring layer and a cyan-coloring layer, or sometimes abbreviated to BL, GL and RL.

Example 1

The surface of a paper support laminated on both sides with polyethylene resin was corona discharged. The support was provided with a gelatin undercoat layer containing sodium dodecylbenzenesulfonate, and further, photographic constituting layers, from the first layer to the seventh layer, described below were coated in order to prepare a multilayer silver halide color photographic material Sample No. 101 shown below. Each coating solution was prepared in the following manner.

Preparation of Coating Solution for Fifth Layer

Cyan Coupler (ExC-1) (300 g), 250 g of Color Image Stabilizer (Cpd-1), 10 g of Color Image Stabilizer (Cpd-9), 10 g of Color Image Stabilizer (Cpd-10), 20 g of Color Image Stabilizer (Cpd-12), 14 g of Ultraviolet Absorber (UV-1), 50 g of Ultraviolet absorber (UV-2), 40 g of Ultraviolet Absorber (UV-3), and 60 g of Ultraviolet Absorber (UV-4) were dissolved in 230 g of a solvent (Solv-6) and 350 ml of ethyl acetate. The obtained solution was dispersed in an emulsified condition into 6,500 g of a 10% aqueous gelatin solution containing 200 ml of 10% sodium dodecylbenzenesulfonate to prepare Emulsified Dispersion C.

On the other hand, Silver Chlorobromide Emulsion C was prepared (cubic form, a mixture in a ratio of 1/4 (silver mol ratio) of large grain size emulsion C having an average grain size of 0.50 μm and small grain size emulsion C having an average grain size of 0.41 μm, variation coefficients of the grain size distribution of the large grain size emulsion and the small grain size emulsion being 0.09 and 0.11, respectively, both emulsions containing 0.5 mol % of silver bromide localized at a part of the grain surface with the substrate being silver chloride).

The red-sensitive Sensitizing Dyes G and H shown below were added in an amount of $6.0\times10^{-5}$ mol, respectively, per mol of the silver, to large grain size emulsion C, and $9.0\times10^{-5}$ mol, respectively, per mol of silver, to small grain size emulsion C. Chemical ripening was conducted optimally by adding a sulfur sensitizer and a gold sensitizer.

The foregoing Emulsified Dispersion C was mixed with this Silver Chlorobromide Emulsion C and dissolved to obtain a coating solution for the fifth layer having the composition described below. The coating amount of the emulsion shows the coating amount in terms of silver.

The coating solutions for the first layer to the fourth layer, the sixth layer and the seventh layer were prepared in the same manner as the coating solution for the first layer. 1-Oxy-3,5-dichloro-s-triazine sodium salt was used as a gelatin hardening agent in each layer.

Further, Ab-1, Ab-2, Ab-3 and Ab-4 were added to each layer so that the total coating amount became 15.0 mg/m$^2$, 60.0 mg/m$^2$, 5.0 mg/m$^2$ and 10.0 mg/m$^2$, respectively.

(Ab-1) Preservative

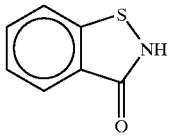

(Ab-2) Preservative

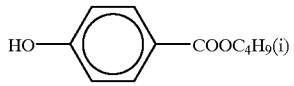

(Ab-3) Preservative

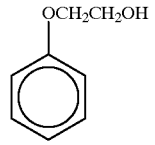

(Ab-4) Preservative

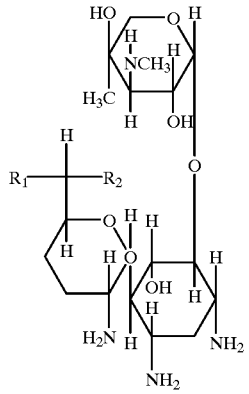

| | $R_1$ | $R_2$ |
|---|---|---|
| a | $-CH_3$ | $-NHCH_3$ |
| b | $-CH_3$ | $-NH_2$ |
| c | -H | $-NH_2$ |
| d | -H | $-NHCH_3$ |

1/1/1/1 mixture of a/b/c/d

The spectral sensitizing dyes described below were used in the silver chlorobromide emulsion of each light-sensitive emulsion layer.

Sensitizing Dyes for Blue-Sensitive Emulsion Layer:

Sensitizing Dye A

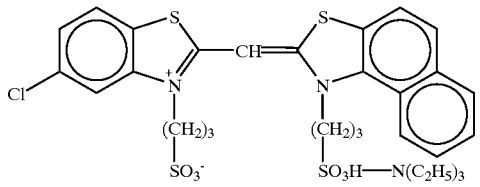

Sensitizing Dye B

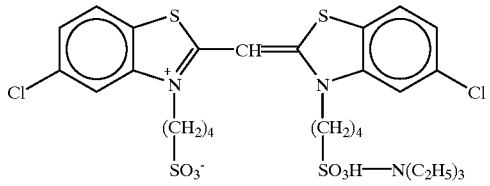

Sensitizing Dye C

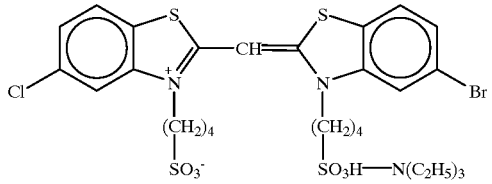

Sensitizing Dye A-II

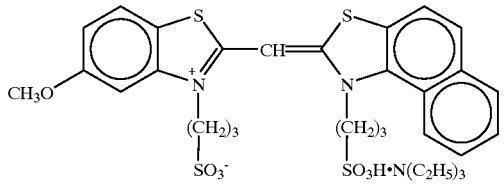

(Sensitizing Dyes A and C in an amount of $0.42\times10^{-4}$ mol per mol of the silver halide, respectively, and Sensitizing Dye B in an amount of $3.4\times10^{-4}$ mol per mol of the silver halide)

Sensitizing Dyes for Green-Sensitive Emulsion Layer:

Sensitizing Dye D

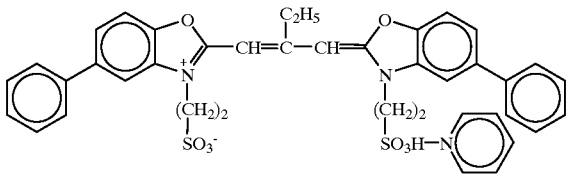

(in an amount of $3.0\times10^{-4}$ mol per mol of the silver halide to the large grain size emulsion and in an amount of $3.6\times10^{-4}$ mol per mol of the silver halide to the small grain size emulsion)

Sensitizing Dye E

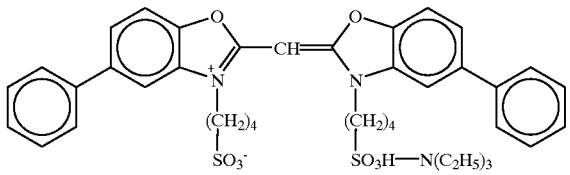

(in an amount of $4.0\times10^{-5}$ mol per mol of the silver halide to the large grain size emulsion and in an amount of $7.0\times10^{-5}$ mol per mol of the silver halide to the small grain size emulsion)

Sensitizing Dye F

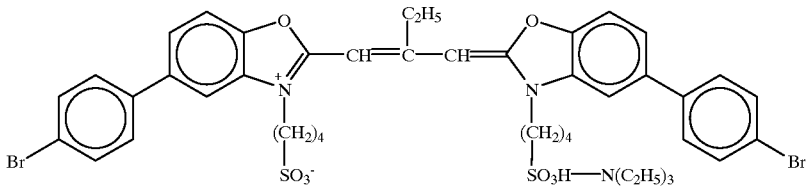

(in an amount of $2.0\times10^{-4}$ mol per mol of the silver halide to the large grain size emulsion and in an amount of $2.8\times10^{-4}$ mol per mol of the silver halide to the small grain size emulsion)

Sensitizing Dyes for Red-Sensitive Emulsion Layer:

Sensitizing Dye G

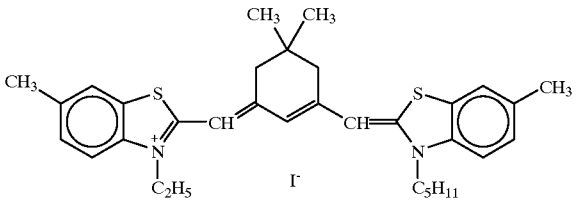

Sensitizing Dye H

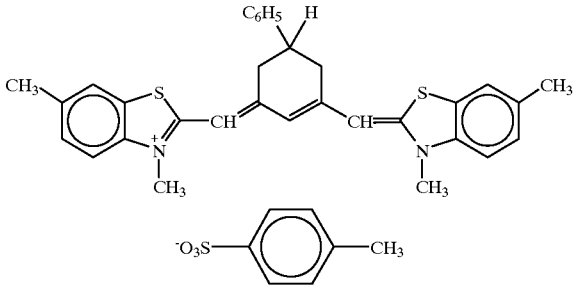

(each in an amount of $6.0\times10^{-5}$ mol per mol of the silver halide to the large grain size emulsion, and each in an amount of $10.7\times10^{-5}$ mol per mol of the silver halide to the small grain size emulsion)

Further, the following Compound I was added to the red-sensitive emulsion layer in an amount of $3.0\times10^{-3}$ mol per mol of the silver halide.

Compound I

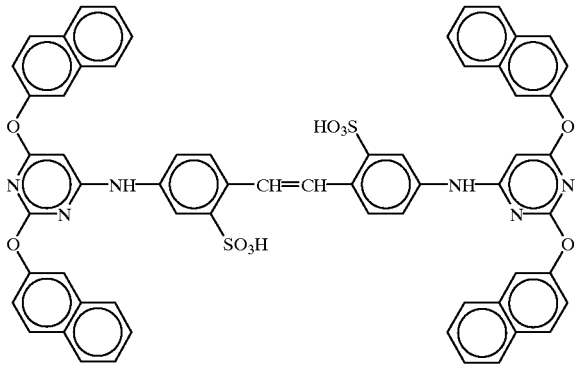

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide.

Further, 1-(3-methylureidophenyl)-5-mercaptotetrazole was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetra-azaindene was added to the blue-sensitive emulsion layer and the green-sensitive emulsion layer in an amount of $1\times10^{-4}$ mol and $2\times10^{-4}$ mol, respectively, per mol of the silver halide.

Copolymer of methacrylic acid and butyl acrylate (polymerization ratio: 1/1, average molecular weight: from 200,000 to 400, 000) was added to the red-sensitive emulsion layer in an amount of 0.05 g/m$^2$.

Further, disodium catechol-3, 5-disulfonate was added to the second layer, the fourth layer and the sixth layer in an amount of 6 mg/m$^2$, 6 mg/m$^2$ and 18 mg/m$^2$, respectively.

Moreover, the following dyes were added to the emulsion layers for preventing irradiation (the numerals in parentheses represent the coating amount).

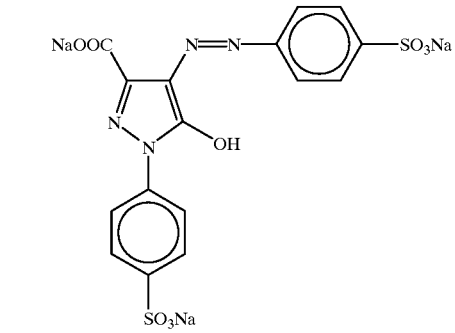

(10mg/m$^2$)

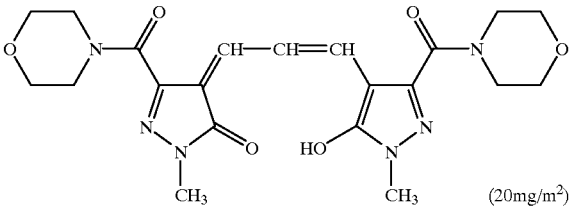

(20mg/m$^2$)

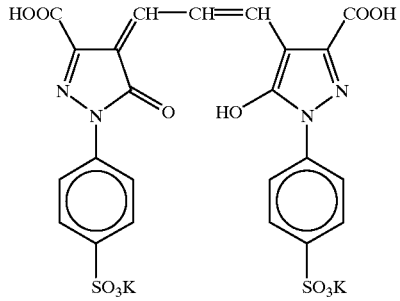

(5mg/m$^2$)

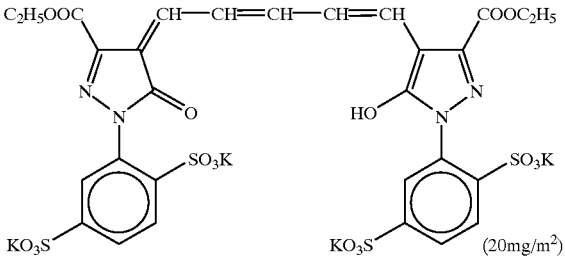

(20mg/m$^2$)

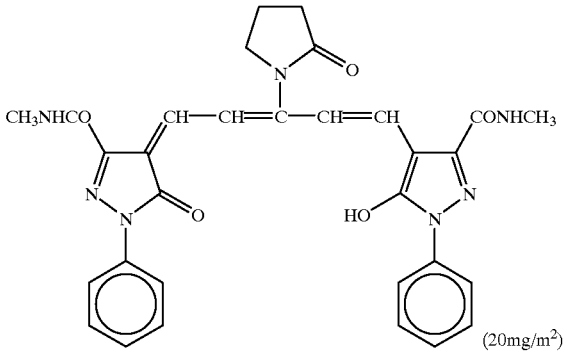

(20mg/m$^2$)

Layer Constitution

The constitution of each layer is described below. The numeral represents the coating amount (g/m$^2$). The numeral for silver halide emulsion represents the coating amount in terms of silver.

Support

Polyethylene resin-laminated paper (a white pigment ($TiO_2$, content: 16 wt %, ZnO, content: 4 wt %), a brightening agent (a mixture in a ratio of 8/2 of 4,4'-bis(benzoxazolyl)stilbene and 4,4'-bis(5-methylbenzoxazolyl) stilbene, content: 0.05 wt %), and a blue dye (ultramarine) were added to the polyethylene resin of the first layer side).

First Layer (Blue-sensitive Emulsion Layer)

Silver Chlorobromide Emulsion A (a cubic form, 0.26 average grain size: 0.74 μm, variation coefficients of the grain size distribution: 0.08, containing 0.3 mol % of silver bromide localized at a part of the grain surface with the remaining substrate being silver chloride)

| | |
|---|---|
| First layer (blue-sensitive emulsion layer) | |
| Silver Chlorobromide Emulsion A (a cubic form, average grain size: 0.74 μm, variation coefficients of the grain size distribution: 0.08, containing 0.3 mol % of silver bromide localized at a part of the grain surface with the remaining substrate being silver chloride) | 0.26 |
| Gelatin | 1.35 |
| Yellow Coupler (ExY) | 0.62 |
| Color Image Stabilizer (Cpd-1) | 0.05 |
| Color Image Stabilizer (Cpd-2) | 0.04 |
| Color Image Stabilizer (Cpd-3) | 0.08 |
| Solvent (Solv-1) | 0.23 |
| Second Layer (color mixture preventing layer) | |
| Gelatin | 0.99 |
| Color Mixing Preventive (Cpd-4) | 0.09 |
| Color Mixing Preventive (Cpd-5) | 0.018 |
| Color Image Stabilizer (Cpd-6) | 0.13 |
| Color Mixing Preventive (Cpd-7) | 0.01 |
| Solvent (Solv-1) | 0.06 |
| Solvent (Solv-2) | 0.22 |
| Third Layer (green-sensitive emulsion layer) | |
| Silver Chlorobromide Emulsion B (a cubic form, a mixture in a ratio of 1/3 (silver mol ratio) of large grain size emulsion B having an average grain size of 0.45 μm and small grain size emulsion B having an average grain size of 0.35 μm; variation coefficients of the grain size distribution were 0.10 and 0.08, respectively, both of them contained 0.4 mol % of silver bromide localized at a part of the grain surface, and the remaining substrate being comprising silver chloride) | 0.14 |
| Gelatin | 1.36 |
| Magenta Coupler (ExM) | 0.15 |
| Ultraviolet Absorber (UV-1) | 0.05 |
| Ultraviolet Absorber (UV-2) | 0.03 |
| Ultraviolet Absorber (UV-3) | 0.02 |
| Ultraviolet Absorber (UV-4) | 0.04 |
| Color Image Stabilizer (Cpd-2) | 0.02 |
| Color Mixing Preventive (Cpd-4) | 0.002 |
| Color Image Stabilizer (Cpd-6) | 0.09 |
| Color Image Stabilizer (Cpd-8) | 0.02 |
| Color Image Stabilizer (Cpd-9) | 0.03 |
| Color Image Stabilizer (Cpd-10) | 0.01 |
| Color Image Stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (color mixture preventing layer) | |
| Gelatin | 0.71 |
| Color Mixing Preventive (Cpd-4) | 0.06 |
| Color Image Stabilizer (Cpd-5) | 0.013 |
| Color Image Stabilizer (Cpd-6) | 0.10 |
| Color Image Stabilizer (Cpd-7) | 0.007 |
| Solvent (Solv-1) | 0.04 |
| Solvent (Solv-2) | 0.16 |
| Fifth Layer (red-sensitive emulsion layer) | |
| Silver Chlorobromide Emulsion C (a cubic form, a mixture in a ratio of 1/4 (silver mol ratio) of large grain size emulsion C having an average grain size of 0.50 μm and small grain size emulsion C having an average grain size of 0.41 μm; variation | 0.20 |

-continued

| | |
|---|---|
| coefficients of the grain size distribution were 0.09 and 0.11, respectively, both of them contained 0.5 mol % of silver bromide localized at a part of the grain surface, and the remaining substrate being comprising silver chloride) | |
| Gelatin | 0.11 |
| Cyan Coupler (ExC-1) | 0.24 |
| Cyan Coupler (ExC-2) | 0.02 |
| Ultraviolet Absorber (UV-1) | 0.14 |
| Ultraviolet Absorber (UV-2) | 0.05 |
| Ultraviolet Absorber (UV-3) | 0.04 |
| Ultraviolet Absorber (UV-4) | 0.06 |
| Color Image Stabilizer (Cpd-1) | 0.25 |
| Color Image Stabilizer (Cpd-9) | 0.01 |
| Color Image Stabilizer (Cpd-10) | 0.01 |
| Color Image Stabilizer (Cpd-12) | 0.02 |
| Solvent (Solv-6) | 0.23 |
| Sixth Layer (ultraviolet absorbing layer) | |
| Gelatin | 0.66 |
| Ultraviolet Absorber (UV-1) | 0.19 |
| Ultraviolet Absorber (UV-2) | 0.06 |
| Ultraviolet Absorber (UV-3) | 0.06 |
| Ultraviolet Absorber (UV-4) | 0.05 |
| Ultraviolet Absorber (UV-5) | 0.09 |
| Solvent (Solv-7) | 0.25 |
| Seventh Layer (protective layer) | |
| Gelatin | 1.00 |
| Acryl-Modified Copolymer of Polyvinyl Alcohol (modification degree: 17%) | 0.04 |
| Liquid Paraffin | 0.02 |
| Surfactant (Cpd-13) | 0.01 |

The compounds used for preparing the composition of each layer described above are shown below.

(ExY) Yellow Coupler

60/40 mixture by mol ratio of

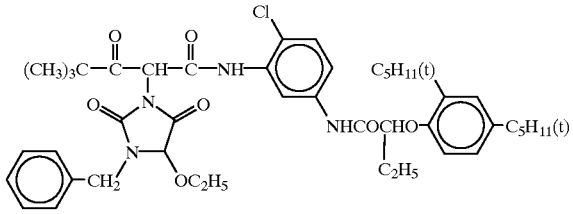

and

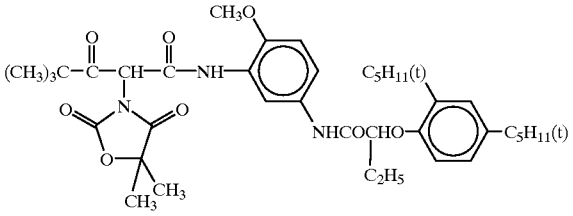

(ExM) Magenta Coupler

60/40 mixture by mol ratio of

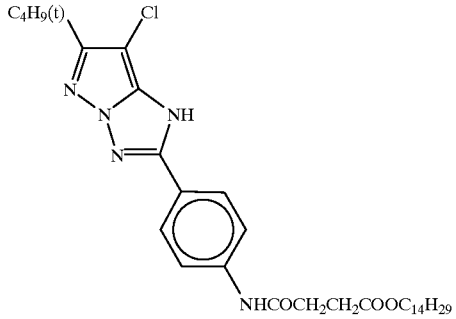

and

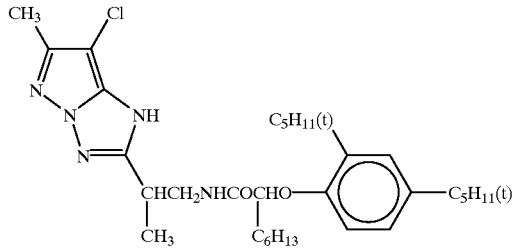

(ExC-1) Cyan Coupler

15/85 mixture by mol ratio of

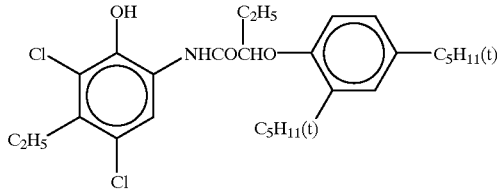

and

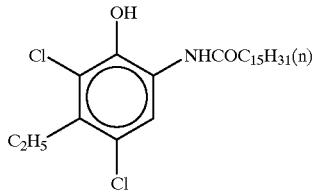

(ExC-2) Cyan Coupler

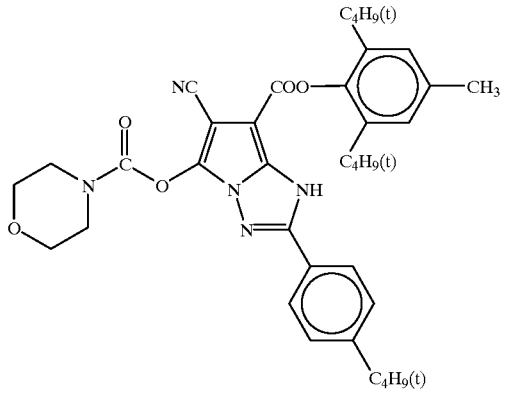

(Cpd-1) Color Image Stabilizer

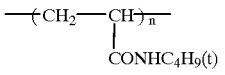

average molecular weight: 60,000

(Cpd-2) Color Image Stabilizer

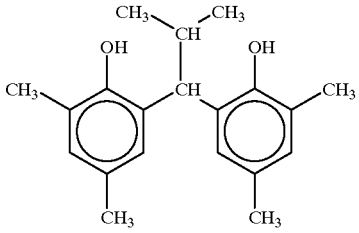

(Cpd-3) Color Image Stabilizer

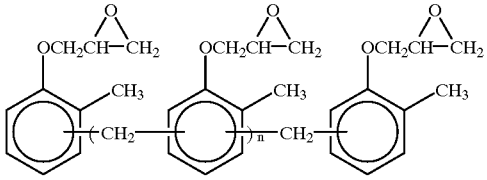

n = 7 to 8 (average value)

(Cpd-4) Color Mixing Preventive

1/1/1 mixture by mol ratio of

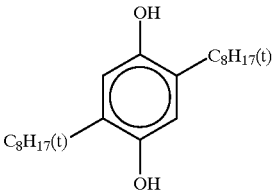

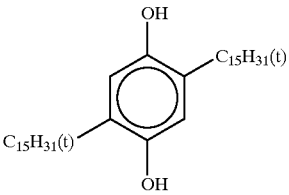

and

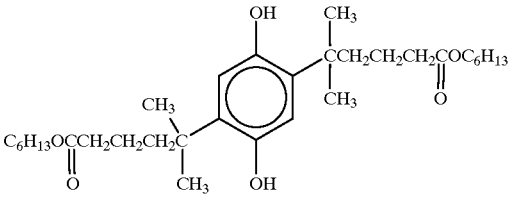

(Cpd-5) Color Mixing Preventive

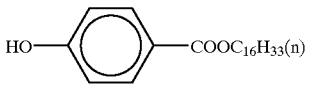

(Cpd-6) Color Image Stabilizer

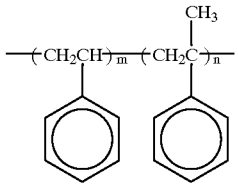

number average molecular weight; 600, m/n=1/9

(Cpd-7) Color Mixing Preventive

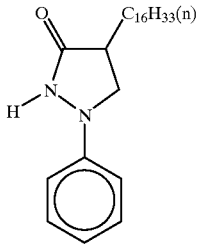

(Cpd-8) Color Image Stabilizer

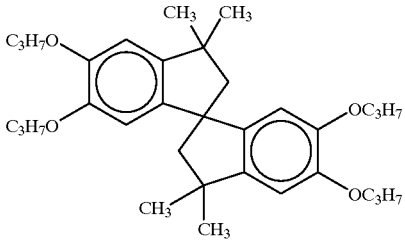

(Cpd-9) Color Image Stabilizer

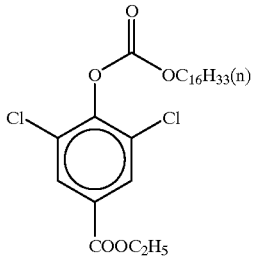

(Cpd-10) Color Image Stabilizer

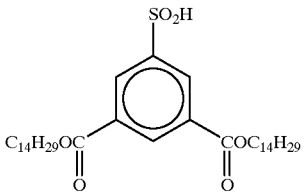

(Cpd-11) Color Image Stabilizer

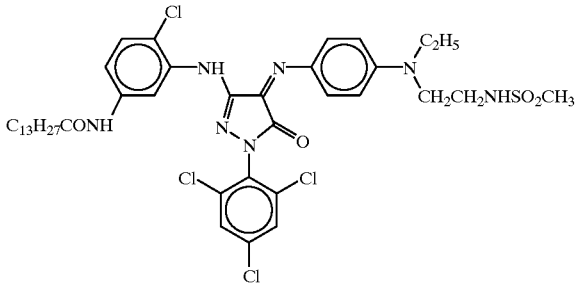

(Cpd-12) Color Image Stabilizer

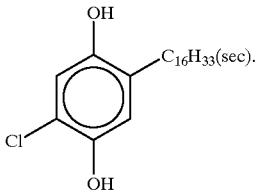

(Cpd-13) Surfactant

7/3 mixture by mol ratio of

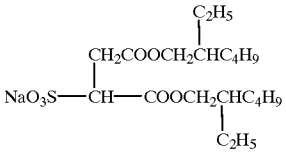

and

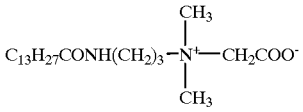

(UV-1) UV Absorber

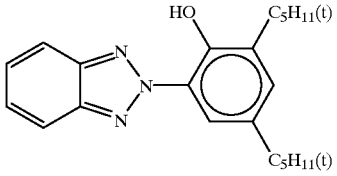

(UV-2) UV Absorber

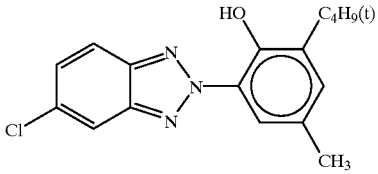

-continued (UV-3) UV Absorber

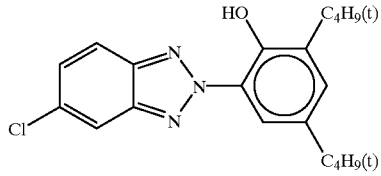

(UV-4) UV Absorber

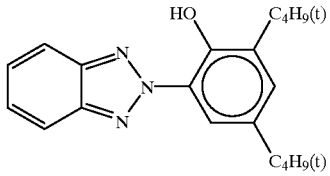

(UV-4) UV Absorber

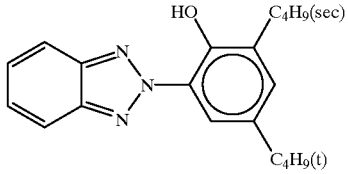

[0184]

(Solv-1) Solvent

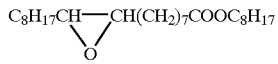

(Solv-2) Solvent

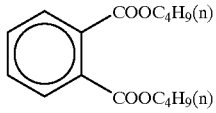

(Solv-3) Solvent

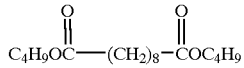

(Solv-4) Solvent

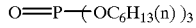

(Solv-5) Solvent

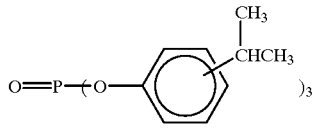

(Solv-6) Solvent

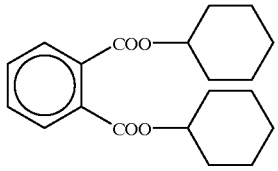

(Solv-7) Solvent

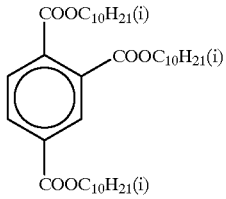

Sample Nos. 102 to 112 were prepared in the same manner as in the preparation of Sample No. 101 except that the factors 1) to 3) shown below were changed.

1) Change of Total Gelatin Amount

The total amount of gelatin was changed by reducing by 25% of the gelatin binder of each constitutional layer exclusive of the yellow coupler-containing blue-sensitive emulsion layer in Sample No. 101 (Sample Nos. 102, 104, 106, 108, 109, 110, 111 and 112, see Table 3).

2) Change of Order of Coloring Layer

The order of the yellow coupler-containing emulsion layer, the magenta coupler-containing emulsion layer and the cyan coupler-containing emulsion layer from the nearest side to the support was changed (Sample Nos. 103, 104, 107, 108, 110, 111 and 112, see Table 3).

3) Change of Emulsion in Yellow Coupler-containing Blue-sensitive Emulsion Layer The emulsion grain of Silver Chlorobromide Emulsion A in the yellow coupler-containing layer in Sample No. 101 was changed to the following four kinds similar emulsions (Sample Nos. 105 to 112, each grain size of the emulsion was shown in Table 3).

These four kinds of emulsions were prepared in the same manner as in the preparation of Silver Chlorobromide Emulsion A except that grain sizes were adjusted by a double jet method with a silver nitrate solution and a halide solution. Grains are each cube having average grain size of 0.45 μm, 0.90 μm, 0.58 μm, and 0.32 μm, respectively (variation coefficients were 0.11, 0.09, 0.10 and 0.14, respectively), and each emulsion contained 0.4 mol % of silver bromide localized at a part of the grain surface with the substrate being silver chloride. The amount of the sensitizing dye of each emulsion was adjusted so that the coating amounts of Emulsion A and the sensitizing dye became the same.

TABLE 3

| Sample No. | Order of Coloring Layer (from the support to the upper layer) | Total Gelatin Coating Amount ($g/m^2$) | Average Grain Size of Emulsion in Yellow Coupler-Containing Layer (μm*) |
|---|---|---|---|
| 101 | Y, M, C | 6.88 | 0.74 |
| 102 | Y, M, C | 5.75 | 0.74 |
| 103 | C, M, Y | 6.88 | 0.74 |
| 104 | C, M, Y | 5.75 | 0.74 |
| 105 | Y, M, C | 6.88 | 0.45 |
| 106 | Y, M, C | 5.75 | 0.45 |
| 107 | C, M, Y | 6.88 | 0.45 |
| 108 | C, M, Y | 5.75 | 0.45 |
| 109 | M, Y, C | 5.75 | 0.45 |
| 110 | C, M, Y | 5.75 | 0.90 |
| 111 | C, M, Y | 5.75 | 0.58 |
| 112 | C, M, Y | 5.75 | 0.32 |

*The average grain size was the value normalized to the diameter corresponding to the sphere in terms of volume.

Development Process and Evaluation

Each of Sample Nos. 101 to 112 was processed to a roll having 127 mm width and subjected to development test according to the following step with mini-lab printer processor PP728 (manufactured by Fuji Photo Film Co., Ltd.). Processor PP728 was modified so as to be able to arbitrarily change the processing time.

Development Processing

Each processing step was as follows.

| Processing Step | Processing Temperature (° C.) | Processing Time (sec) |
|---|---|---|
| Color Development | Shown in Table 4* | 12 |
| Blixing | 40 | 12 |
| Rinsing (1)** | 40 | 4 |
| Rinsing (2)** | 40 | 4 |
| Rinsing (3)** | 40 | 4 |
| Rinsing (4)** | 40 | 10 |
| Drying | | |

*With each photographic material, the temperature was set up so as to obtain the maximum density of each emulsion layer with color developing time of 12 seconds. The temperature is shown in Table 4.
**Rinsing was conducted in a 4-tank countercurrent system from rinsing (4) to rinsing (1).

The composition of each processing solution used is described below.

Color Developing Solution

| | |
|---|---|
| Water | 800 ml |
| Ethylenediaminetetraacetic Acid | 4.0 g |
| Disodium 4,5-Dihydroxybenzene-1,3-disulfonate | 0.5 g |
| Triisopropanolamine | 10.0 g |
| Potassium Chloride | 10.0 g |
| Potassium Bromide | 0.04 g |
| Sodium p-toluenesulfonate | 20.0 g |
| Potassium Carbonate | 27.0 g |
| Triazinyldiaminostilbene-Based Brightening Agent (Hakkol FWA-SF, a product of Showa Kagaku Kogyo Co., Ltd.) | 3.5 g |
| Sodium Sulfite | 0.1 g |
| Disodium-N,N-bis(sulfonatoethyl)-hydroxylamine | 10.0 g |
| Sodium Triisopropylene(β)-sulfonate | 0.1 g |
| N-Ethyl-N-(β-methanesulfonamido-ethyl)-3-methyl-4-amino-aniline · 3/2 Sulfate · Monohydrate | 10.0 g |
| Water to make | 1,000 ml |
| pH (25° C., adjusted with potassium hydroxide and sulfuric acid) | 10.25 |

Blixing Solution

| | |
|---|---|
| Water | 600 ml |
| Ammonium Thiosulfate (750 g/liter) | 110 ml |
| Ammonium Sulfite | 40 g |
| Ammonium Ethylenediamine-tetraacetato Ferrate (III) | 55 g |
| Ethylenediaminetetraacetic Acid | 5 g |
| Citric Anhydride | 20 g |
| Water to make | 1,000 ml |
| pH (25° C., adjusted with nitric acid and aqueous ammonia) | 5.5 |

Rinsing Solution

| | |
|---|---|
| Sodium Chlorinated Isocyanurate | 0.02 g |
| Deionized water (electric | 1,000 ml |

-continued

| | |
|---|---|
| conductivity: 5 μs/cm or less) | |
| pH | 6.5 |

Measurement and Evaluation

Measurement of the results of development and evaluation were conducted as follows.

(1) Measurement of Development Proceeding Velocity (the Reciprocal of the Developing Time Required to Reach the Density of ½ of the Maximum Density)

Each of Sample Nos. 101 to 112 was subjected to exposure with white light with a sensitometer (FWH model manufactured by Fuji Photo Film Co., Ltd., color temperature of the light source: 3,200° K) through continuous gradation wedge of a neutral color (gray), and then development processed.

The exposure conditions were adjusted so that each density of R, G and B (the density each measured with red, green and blue filters, hereinafter called as the same) became 1.0 with the same exposure amount in the prescribed processing time. At the exposure amount higher by 1.0 LogE than the exposure amount corresponding to density 1.0 (the exposure amount corresponding to the maximum ultimate density), the change of each density of R, G and B to the developing time was measured and the developing time required to reach the density of ½ of the maximum density was measured. The measurement of the development density was performed every 2 seconds until the prescribed time. The reciprocal of the developing time required to reach the density of ½ of the obtained maximum density was taken as the development proceeding velocity. The ratio of the development proceeding velocity of the emulsion layer nearest to the support to the development proceeding velocity of the emulsion layer farthest from the support (the uppermost layer) is shown in Table 4.

(2) Measurement of Minimum Density

The density through a blue filter (yellow density) of the unexposed part of the photographic material processed in the prescribed time was measured with a Macbeth densitometer (a densitometer conforming to International Standard ISO 5-2 and 3). The results obtained are shown in Table 4 as DBmin.

(3) Evaluation of Development Unevenness

Each sample was subjected to uniform exposure to give gray (neutral color) of density 0.5, and then processed according to the following processing step and processing composition. After development process, the existence of development unevenness was visually observed. Further, as the determined value of the degree of unevenness, the magenta density difference (green filter density) between the high density area and the low density area by uniform exposure was measured with a Macbeth densitometer. The results obtained are shown in Table 4.

The criteria of the visual evaluation of development unevenness are as follows.

○: Development unevenness was not observed.

Δ: Development unevenness was observed a little but in a practicable range.

×: Development unevenness was conspicuous and impracticable.

The determined value of the magenta density difference due to development unevenness which was measured by a Macbeth densitometer is shown in Tables 4 and 6 as $\Delta D_G$.

TABLE 4

| Expt. No. | Sample No. | Color Development Temperature (° C.) | Ratio of Development Proceeding Velocity (lowermost layer/uppermost layer) | Minimum Density DBmin | Development Unevenness Visual Evaluation | $\Delta D_G$ | Remarks |
|---|---|---|---|---|---|---|---|
| 1 | 101 | 53.5 | 0.51 | 0.105 | x | 0.8 | Comparison |
| 2 | 102 | 53.0 | 0.50 | 0.108 | x | 0.8 | Comparison |
| 3 | 103 | 50.0 | 1.90 | 0.073 | Δ | 0.2 | Invention |
| 4 | 104 | 50.0 | 1.82 | 0.072 | Δ | 0.1 | Invention |
| 5 | 105 | 53.0 | 0.74 | 0.079 | Δ | 0.1 | Invention |
| 6 | 106 | 52.5 | 0.80 | 0.076 | Δ | 0.1 | Invention |
| 7 | 107 | 48.0 | 1.08 | 0.073 | ○ | 0.0 | Invention |
| 8 | 108 | 45.0 | 1.15 | 0.070 | ○ | 0.0 | Invention |
| 9 | 109 | 45.0 | 1.20 | 0.071 | ○ | 0.0 | Invention |
| 10 | 110 | 52.0 | 2.10 | 0.074 | x | 0.6 | Comparison |
| 11 | 111 | 48.0 | 1.31 | 0.071 | ○ | 0.0 | Invention |
| 12 | 112 | 44.5 | 1.04 | 0.069 | ○ | 0.0 | Invention |

Results

Table 4 is the results obtained by changing photographic factors such as the grain size of the emulsion, the thickness of the emulsion layer (the amount of gelatin binder), the order of the photosensitive layers, and the development temperature, but, whatever factor may change, the minimum density is low when the ratio of the development proceeding velocity of the lowermost layer to the uppermost layer is from 0.7 to 2.0. Thus, good results showing no development unevenness could be obtained. Of the samples of the present invention, especially preferred results could be obtained when the ratio of the development proceeding velocity was from 1.0 to 2.0.

Example 2

(1) Preparation of Photographic Material Sample

Sample Nos. 201 to 214 were prepared in the same manner as in the preparation of Sample Nos. 101 to 112 except that any of the following Emulsions F, G, H, I and J were used in place of the silver chlorobromide emulsion in the yellow coupler-containing layer. The content of each sample is shown in Table 5.

TABLE 5

| Sample No. | Order of Coloring Layer (from the support to the upper layer) | Total Gelatin Coating Amount ($g/m^2$) | Average Grain Size and Emulsion Used in Yellow Coupler-Containing Layer ($\mu m^*$) |
|---|---|---|---|
| 201 | Y, M, C | 6.88 | G (0.61) |
| 202 | Y, M, C | 5.75 | G (0.61) |
| 203 | C, M, Y | 6.88 | G (0.61) |
| 204 | C, M, Y | 5.75 | G (0.61) |
| 205 | Y, M, C | 6.88 | F (0.46) |
| 206 | Y, M, C | 5.75 | F (0.46) |
| 207 | C, M, Y | 6.88 | F (0.46) |
| 208 | C, M, Y | 5.75 | F (0.46) |
| 209 | M, Y, C | 5.75 | F (0.46) |
| 210 | C, M, Y | 5.75 | H (0.75) |
| 211 | C, M, Y | 5.75 | I (0.56) |
| 212 | C, M, Y | 5.75 | J (0.38) |
| 213 | C, M, Y | 5.75 | D (0.33) |
| 214 | C, M, Y | 5.75 | E (0.30) |

Preparation of Emulsion (1) Emulsion D, preparation of {111} high silver chloride content tabular grains, average grain size: 0.33 $\mu$n Two point zero (2.0) grams of sodium chloride and 2.4 g of inactivated gelatin were added to 1.2 liters of water, and 45 ml of an aqueous solution of silver nitrate (silver nitrate: 18 g) and 45 ml of an aqueous solution of sodium chloride (sodium chloride: 6.2 g) were added by a double jet method over 1 minute to the vessel maintained at 33° C., with stirring. One minute after the completion of the addition, 0.8 mmol of Crystal Phase Controller 1 was added to the reaction vessel. After the elapse of further one minute, 1.0 g of sodium chloride was added thereto. The temperature of the reaction vessel was increased to 60° C. during the succeeding 25 minutes. Ripening was carried out for 16 minutes while maintaining the temperature at 60° C., then 560 g of a 10% aqueous solution of phthalated gelatin and 0.8 mmol of Crystal Phase Controller 1 were added thereto. Subsequently, after the pCl of the reaction vessel was adjusted to 1.24, 255.0 ml of an aqueous solution of silver nitrate (silver nitrate: 102 g) and 255.0 ml of an aqueous solution of sodium chloride (sodium chloride: 35.3 g) were added at an accelerated flow rate over 11 minutes. During the last 9 to 11 minutes of 11 minutes, i.e., from 9 to 11 minutes after the beginning of addition of aqueous solutions of silver nitrate and sodium chloride until 11 minutes, an aqueous solution containing 3 mg of yellow prussiate of potash was added to the reaction solution.

After completion of the addition, 27.0 ml of an aqueous solution containing 1.0% potassium thiocyanate and Sensitizing Dyes A-II, B and C in an amount of 0.24 mmol, 0.36 mmol and 0.05 mmol, respectively, per mol of the silver were added to the reaction solution, and then the temperature was raised to 75° C. and followed by stirring further 20 minutes.

After lowering the temperature to 40° C., the emulsion was desalted by an ordinary flocculation method. After the emulsion was washed with water, 67 g of gelatin, 80 ml of phenol (5%) and 150 ml of distilled water were added to the reaction system. pH was adjusted to 6.2 and pAg to 7.5 with sodium hydroxide and a silver nitrate solution.

The thus-obtained emulsion contained tabular grains whose 95% or more of the projected area had an average equivalent-sphere diameter of 0.33 $\mu$m, an average thickness of 0.102 $\mu$m and an aspect ratio of 2 or more. The variation coefficients of the thickness and equivalent-circle radius were 21.5% and 24.3%, respectively.

(2) Emulsion E

Grains were formed in the same manner as the preparation of Emulsion D except that 0.24 g of potassium iodide was added to the reaction solution with 3 mg of yellow prussiate of potash over 9 to 11 minutes at the final stage of the grain formation.

The thus-obtained emulsion contained tabular grains whose 95% or more of the projected area had an average equivalent-sphere diameter of 0.30 $\mu$m, an average thickness of 0.106 $\mu$m and an aspect ratio of 2 or more. The variation coefficients of the thickness and equivalent-circle radius were 18.6% and 19.0%, respectively.

(3) Emulsion F, Preparation of {111} High Silver Chloride Content Tabular Grains, Average Grain Size: 0.46 $\mu$n Two point zero (2.0) grams of sodium chloride and 2.8 g of inactivated gelatin were added to 1.2 liters of water, and 45 ml of an aqueous solution of silver nitrate (silver nitrate: 18 g) and 45 ml of an aqueous solution of sodium chloride (sodium chloride: 6.4 g) were added by a double jet method over 1 minute to the vessel maintained at 33° C., with stirring. One minute after the completion of the addition, 0.8 mmol of Crystal Phase Controller 1 and 560 g of an aqueous solution of 10% phthalated gelatin were added to the reaction vessel. After the elapse of further one minute, 3.0 g of sodium chloride was added thereto. The temperature of the reaction vessel was increased to 60° C. during the succeeding 25 minutes. Ripening was carried out for 16 minutes while maintaining the temperature at 60° C., then 3 g of sodium chloride and $1\times10^{-5}$ mol of sodium thiosulfate were added thereto. Subsequently, 295 ml of an aqueous solution of silver nitrate (silver nitrate: 18 g), 295 ml of an aqueous solution of sodium chloride (containing 50.3 g of sodium chloride and $\mathbf{2\times10^{-8}}$ mol of iridium hexachloride) and 160 ml of an aqueous solution of Crystal Phase Controller 1 (M/50) were added at an accelerated flow rate over 13 minutes. Two minutes after the termination of the addition, an aqueous silver nitrate solution (containing 34 g of silver nitrate) and an aqueous sodium chloride solution (containing 11.6 g of sodium chloride and 1.27 mg of yellow prussiate of potash) were added to the reaction solution over 5 minutes. Subsequently, 33.5 ml of a 0.1N thiocyanic acid solution, 0.32 mmol of Sensitizing A, 0.48 mmol of Sensitizing Dye B and 0.05 mmol of Sensitizing Dye C were added thereto.

After lowering the temperature to 40° C., the emulsion was desalted by an ordinary flocculation method. After the emulsion was washed with water, 67 g of gelatin, 80 ml of phenol (5%) and 150 ml of distilled water were added to the reaction system. pH was adjusted to 6.2 and pAg to 7.5 with sodium hydroxide and a silver nitrate solution.

The thus-obtained emulsion contained tabular grains whose 90% or more of the projected area had an average equivalent-circle diameter of 0.71 $\mu$m, an average thickness of 0.13 $\mu$m and an average equivalent-sphere diameter of 0.46 $\mu$m.

Crystal Phase Controller 1

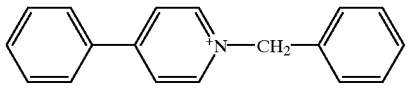

(4) Emulsion G, Preparation of {111} High Silver Chloride Content Tabular Grains, Average Grain Size: 0.61 $\mu$n Two point zero (2.0) grams of sodium chloride and 2.8 g of inactivated gelatin were added to 1.2 liters of water, and 60 ml of an aqueous solution of silver nitrate (silver nitrate: 9 g) and 60 ml of an aqueous solution of sodium chloride (sodium chloride: 3.2 g) were added by a double jet method over 1 minute to the vessel maintained at 35° C., with stirring. One minute after the completion of the addition, 0.8 mmol of Crystal Phase Controller 1 was added to the reaction vessel. After the elapse of further one minute, 3.0 g of sodium chloride was added thereto. The temperature of the reaction vessel was increased to 60° C. during the succeeding 25 minutes. Ripening was carried out for 16 minutes while maintaining the temperature at 60° C., then 560 g of an aqueous solution of 10% phthalated gelatin and $1\times10^{-5}$ mol of sodium thiosulfate were added thereto. Subsequently, 317.5 ml of an aqueous solution of silver nitrate (silver nitrate: 127 g), 317.5 ml of an aqueous solution of sodium chloride (containing 54.1 g of sodium chloride and $2\times10^{-8}$ mol of iridium hexachloride) and 160 ml of an aqueous solution of Crystal Phase Controller 1 (M/50) were added at an accelerated flow rate over 20 minutes. Two minutes after the termination of the addition, an aqueous silver nitrate solution (containing 34 g of silver nitrate) and an aqueous sodium chloride solution (containing 11.6 g of sodium chloride and 1.27 mg of yellow prussiate of potash) were added to the reaction solution over 5 minutes. Subsequently, 33.5 ml of a 0.1N thiocyanic acid solution, 0.32 mmol of Sensitizing A, 0.48 mmol of Sensitizing Dye B and 0.05 mmol of Sensitizing Dye C were added thereto.

After lowering the temperature to 40° C., the emulsion was desalted by an ordinary flocculation method. After the emulsion was washed with water, 67 g of gelatin, 80 ml of phenol (5%) and 150 ml of distilled water were added to the reaction system. pH was adjusted to 6.2 and pAg to 7.5 with sodium hydroxide and a silver nitrate solution.

The thus-obtained emulsion contained tabular grains whose 90% or more of the projected area had an average equivalent-circle diameter of 1.05 Am, an average thickness of 0.14 μm and an average equivalent-sphere diameter of 0.61 μm.

(5) Emulsion H

Grains were formed in the same manner as the preparation of Emulsion G except that the addition of 317.5 ml of an aqueous solution of sodium chloride and 160 ml of an aqueous solution of Crystal Phase Controller 1 (M/50) was performed over 40 minutes. The obtained tabular grain had an average equivalent-sphere diameter of 0.75 μm.

(6) Emulsion I

Grains were formed in the same manner as the preparation of Emulsion F except that the addition of 295 ml of an aqueous solution of silver nitrate, 295 ml of an aqueous sodium chloride solution and 160 ml of an aqueous solution of Crystal Phase Controller 1 (M/50) was performed over 26 minutes. The obtained tabular grain had an average equivalent-sphere diameter of 0.56 μm.

(7) Emulsion J

Grains were formed in the same manner as the preparation of Emulsion F except that the addition of 45 ml of an aqueous solution of silver nitrate and 45 ml of an aqueous sodium chloride solution was performed at 27° C. The obtained tabular grain had an average equivalent-sphere diameter of 0.38 μm.

(2) Development Process

Each of Sample Nos. 201 to 212 was processed to a roll having 127 mm width and subjected to the test according to the following step with mini-lab printer processor PP728 (manufactured by Fuji Photo Film Co., Ltd.). Processor PP728 was modified so as to be able to arbitrarily change the processing time.

Development Processing

Each processing step was as follows.

| Processing Step | Processing Temperature (° C.) | Processing Time (sec) |
|---|---|---|
| Color Development | Shown in Table 6* | 8 |
| Blixing | 40 | 8 |
| Rinsing (1)** | 40 | 3 |
| Rinsing (2)** | 40 | 3 |
| Rinsing (3)** | 40 | 3 |
| Rinsing (4)** | 40 | 3 |
| Drying | 80 | 10 |

*With each photographic material, the temperature was set up so as to obtain the maximum density of each emulsion layer with color developing time of 8 seconds. The temperature is shown in Table 6.
**Rinsing was conducted in a 4-tank countercurrent system from rinsing (4) to rinsing (1).

The composition of each processing solution used is described below.

Color Developing Solution

| | |
|---|---|
| Water | 800 ml |
| Ethylenediaminetetraacetic Acid | 4.0 g |
| Diodium 4,5-Dihydroxybenzene-1,3-disulfonate | 0.5 g |
| Triisopropanolamine | 10.0 g |
| Potassium Chloride | 8.0 g |
| Potassium Bromide | 0.04 g |
| Sodium p-toluenesulfonate | 30.0 g |
| Potassium Carbonate | 27.0 g |
| Triazinyldiaminostilbene-Based Brightening Agent (Hakkol FWA-SF, a product of Showa Kagaku Kogyo Co., Ltd.) | 4.0 g |
| Sodium Sulfite | 0.1 g |
| Disodium-N,N-bis(sulfonatoethyl)-hydroxylamine | 10.0 g |
| Sodium Triisopropylene(β)-sulfonate | 0.1 g |
| N-Ethyl-N-(β-methanesulfonamido-ethyl)-3-methyl-4-amino-aniline·3/2 Sulfate·Monohydrate | 12.5 g |
| Water to make | 1,000 ml |
| pH (25° C., adjusted with potassium hydroxide and sulfuric acid) | 10.50 |

Blixing Solution

| | |
|---|---|
| Water | 600 ml |
| Ammonium Thiosulfate (750 g/liter) | 120 ml |
| Ammonium Sulfite | 40 g |
| Ammonium Ethylenediamine-tetraacetato Ferrate (III) | 65 g |
| Ethylenediaminetetraacetic Acid | 5 g |
| Succinic Acid | 20 g |
| Water to make | 1,000 ml |
| pH (25° C., adjusted with nitric acid and aqueous ammonia) | 5.5 |

Rinsing Solution

| | |
|---|---|
| Sodium Chlorinated Isocyanurate | 0.02 g |
| Deionized water (electric | 1,000 ml |

-continued

| | |
|---|---|
| conductivity: 5 μs/cm or less) | |
| pH | 6.5 |

(3) Measurement and Evaluation (1) Measurement of Development Proceeding Velocity Measurement was performed in the same manner as in Example 1. The results obtained are shown in Table 6.

(2) Measurement of Minimum Density

Measurement was performed in the same manner as in Example 1. The results obtained are shown in Table 6.

(3) Measurement of Fluctuation of Photographic Characteristics Due to Mixture of Blixing Solution to Color Developing Solution To 1 liter of the color developing solution was added 0.3 ml of the blixing solution, and the fluctuation of sensitivity of the cyan-coloring layer before and after the mixture of the blixing solution to the color developing solution (the change of LogE at density of 0.7, i.e., expressed by "ΔLogE= difference in LogE value between before and after the mixture of the blixing solution") was measured using a Macbeth densitometer. The results obtained are shown in Table 6.

Abbreviations in evaluation of characteristics in Table 6 (e.g., DBmin, etc.) are the same as those in Table 4, etc.

Example 3

(1) Preparation of Photographic Material Sample

Sample Nos. 301 and 302 were prepared in the same manner as in Example 2 except that any of the following Emulsions K and L were used.

(1) Emulsion K ({111} silver chloroiodide tabular grains containing 0.2 mol %, based on the entire silver amount, of iodide in the shell part)

Emulsion K was prepared in the same manner as the preparation of Emulsion F but 4 mmol of potassium iodide was added to the aqueous silver chloride solution added with the silver nitrate aqueous solution at the third addition.

(2) Emulsion L ({100} Silver Chloride Tabular Grains)

To the reaction vessel were added 1,200 ml of water, 25 g of gelatin (deionized alkali-processed ossein gelatin of a methionine content of about 40 μmol/g), 0.4 g of sodium chloride, and 4.5 ml of a 1 N nitric acid solution and the temperature was maintained at 40° C. (pH: 4.5). Subsequently, Ag-1 solution (containing 0.2 g/ml of silver nitrate) and X-1 solution (containing 0.069 g/ml of sodium chloride) were added to the reaction vessel with vigorously stirring at the addition rate of 48 ml/min. over 4 minutes. Fifteen (15) seconds after that, 150 ml of an aqueous polyvinyl alcohol solution (containing 6.7 g of polyvinyl alcohol (hereinafter, PVA-l) wherein average polymerization degree of the vinyl acetate was 1,700, average saponification degree to alcohol was 98%, and 1 liter of water) was added to the reaction vessel.

TABLE 6

| Expt. No. | Sample No. | Color Development Temperature (° C.) | Ratio of Development Proceeding Velocity (lowermost layer/ uppermost layer) | Ratio of Development Proceeding Velocity (BL/RL) | Minimum Density DBmin | Influence of Mixture of Blixing Solution (ΔE) | Remarks |
|---|---|---|---|---|---|---|---|
| 1 | 201 | 54.5 | 0.46 | 0.46 | 0.109 | +0.109 | Comparison |
| 2 | 202 | 54.5 | 0.44 | 0.44 | 0.118 | +0.22 | Comparison |
| 3 | 203 | 52.5 | 1.88 | 0.49 | 0.072 | +0.10 | Invention |
| 4 | 204 | 51.0 | 1.76 | 0.56 | 0.071 | +0.09 | Invention |
| 5 | 205 | 54.0 | 0.72 | 0.72 | 0.071 | +0.08 | Invention |
| 6 | 206 | 53.5 | 0.75 | 0.75 | 0.071 | +0.08 | Invention |
| 7 | 207 | 49.0 | 1.06 | 0.94 | 0.068 | +0.07 | Invention |
| 8 | 208 | 46.0 | 0.90 | 1.11 | 0.069 | +0.01 | Invention |
| 9 | 209 | 45.0 | 1.20 | 1.02 | 0.068 | +0.01 | Invention |
| 10 | 210 | 53.0 | 0.56 | 0.47 | 0.075 | +0.20 | Comparison |
| 11 | 211 | 46.5 | 0.98 | 1.02 | 0.069 | +0.01 | Invention |
| 12 | 212 | 45.5 | 0.85 | 1.18 | 0.070 | +0.01 | Invention |
| 13 | 213 | 45.0 | 0.69 | 1.45 | 0.071 | +0.01 | Invention |
| 14 | 214 | 45.0 | 0.63 | 1.60 | 0.072 | +0.08 | Invention |

Results

In Example 2, the grain size of the emulsion was changed, the order of the photosensitive layers, in which the emulsion having different grain size was used, was changed similarly to Example 1, and the development temperature and other factors on the prescription were changed and each sample was subjected to rapid development such as 8 seconds, but, whatever factor may change, the minimum density is low when the ratio of the development proceeding velocity of the lowermost layer to the uppermost layer is from 0.7 to 2.0 notwithstanding rapid development. Thus, good results could be obtained. Of the samples of the present invention, the fluctuation of the photographic characteristics of the cyan-coloring layer before and after the mixture of the blixing solutions seldom occurred when the ratio of BL to RL was from 1.0 to 1.5, and good results could be obtained.

A 1N nitric acid solution (12.3 ml) was added to the reaction mixture to adjust pH to 3.5. The temperature was raised to 75° C. over 15 minutes, 23 ml of a 1N sodium hydroxide solution was added thereto to adjust pH to 6.5, further, 4.0 ml of 1 -(5-methylureidophenyl)-5-mercaptotetrazole (0.05%), 4.0 ml of N,N'-dimethylimidazolidine-2-thione (a 1% aqueous solution) were added to the reaction solution. Sodium chloride (4 g) was added thereto, and the silver potential (to room temperature saturation calomel electrode) was adjusted to 100 mV. Then, as the growing stage, Ag-1 solution and X-1 solution were added to the reaction mixture at the same time at flow rate of 40 ml/min. linearly increasing to 42 ml/min. for 15 minutes with maintaining the silver potential at 10 mV. Further, 12.5 ml of a 1N nitric acid solution was added thereto to adjust pH to 4.1. Sodium chloride (28.8 g) was added, and the silver potential was adjusted to 60 mV, then 0.38 mmol of Sensitizing Dye A, 0.56 mmol of Sensitizing Dye B, and 0.06 mmol of Sensitizing Dye C were added, and Ag-2 solution (containing 0.1 g/ml of silver nitrate) and X-2 solution (containing 0.0345 g/ml of sodium chloride) were added thereto at the flow rate of 40 ml/min. over 10 minutes. The reaction mixture was then allowed to stand at 75° C. for 10 minutes.

Thereafter, precipitates were washed at 40° C. and desalting was performed. Gelatin (79 g) was added thereto and the emulsion was redispersed to adjust pH and pAg to 6.0 and 7.3, respectively. A part of the emulsion was taken out and the electron microphotograph (TEM image) of the replica of the grain was observed. From the microphotograph, 90% of the projected area of the entire AxG grains were {100} main plane tabular grains having an average equivalent-sphere diameter of 0.47 μm, an average thickness of 0.10 μm, an average aspect ratio of 7.8, and an average adjacent side length ratio of 1.2.

(2) Development Process

Each sample was processed to a roll having 127 mm width and subjected to the test according to the following step with mini-lab printer processor PP728 (manufactured by Fuji Photo Film Co., Ltd.). Processor PP728 was modified so as to be able to arbitrarily change the processing time.

Development Processing

Each processing step was as follows.

| Processing Step | Processing Temperature (° C.) | Processing Time (sec) |
|---|---|---|
| Color Development | Shown in Table 7* | 10, 14, 20, 30 |
| Blixing | 40 | 10 |
| Rinsing (1)** | 40 | 4 |
| Rinsing (2)** | 40 | 4 |
| Rinsing (3)** | 40 | 4 |
| Rinsing (4)** | 40 | 4 |
| Drying | 80 | 10 |

*With each photographic material, the temperature was set up so as to obtain the maximum density of each emulsion layer with color developing time of 10 seconds. The temperature is shown in Table 7.
**Rinsing was conducted in a 4-tank countercurrent system from rinsing (4) to rinsing (1).

The composition of each processing solution used is described below.

Color Developing Solution

| | |
|---|---|
| Water | 800 ml |
| Ethylenediaminetetraacetic Acid | 4.0 g |
| Diodium 4,5-Dihydroxybenzene-1,3-disulfonate | 0.5 g |
| Triisopropanolamine | 10.0 g |
| Potassium Chloride | 6.5 g |
| Potassium Bromide | 0.04 g |
| Sodium p-toluenesulfonate | 20.0 g |
| Potassium Carbonate | 27.0 g |
| Triazinyldiaminostilbene-Based Brightening Agent (Hakkol FWA-SF, a product of Showa Kagaku Kogyo Co., Ltd.) | 4.0 g |
| Sodium Sulfite | 0.1 g |
| Disodium-N,N-bis(sulfonatoethyl)-hydroxylamine | 10.0 g |
| Sodium Triisopropylene(β)-sulfonate | 0.1 g |
| N-Ethyl-N-(β-methanesulfonamido-ethyl)-3-methyl-4-amino-aniline·3/2 Sulfate·Monohydrate | 10.0 g |
| Water to make | 1,000 ml |
| pH (25° C., adjusted with potassium hydroxide and sulfuric acid) | 10.25 |

-continued

Blixing Solution

| | |
|---|---|
| Water | 600 ml |
| Ammonium Thiosulfate (750 g/liter) | 110 ml |
| Ammonium Sulfite | 40 g |
| Ammonium Ethylenediamine-tetraacetato Ferrate (III) | 60 g |
| Ethylenediaminetetraacetic Acid | 5 g |
| Citric Anhydride | 20 g |
| Water to make | 1,000 ml |
| pH (25° C., adjusted with acetic acid and aqueous ammonia) | 5.5 |

Rinsing Solution

| | |
|---|---|
| Sodium Chlorinated Isocyanurate | 0.02 g |
| Deionized water (electric conductivity: 5 μs/cm or less) | 1,000 ml |
| pH | 6.5 |

(3) Measurement and Evaluation (1) Measurement of Development Proceeding Velocity Measurement was performed in the same manner as in Example 1. The results obtained are shown in Table 7. The developing time was changed every 2 seconds until the prescribed time.

(2) Measurement of Minimum Density

Measurement was performed in the same manner as in Example 1. The results obtained are shown in Table 7.

(3) Evaluation of Development Unevenness

Each sample was subjected to uniform exposure to give gray (neutral color) of density 0.5, and then processed according to the above processing step and processing composition. After development process, the existence of unevenness was visually observed. Further, as the degree of unevenness, the magenta density difference was measured with a Macbeth densitometer. The results obtained are shown in Table 7.

(4) Measurement of Fluctuation of Photographic Characteristics Due to Mixture of Blixing Solution to Color Developing Solution The fluctuation of sensitivity of the cyan-coloring layer before and after the mixture of the blixing solution to the color developing solution (the change of LogE at density of 0.7, i.e., expressed by "ΔLogE=LogE value after the mixture of the blixing solution−LogE value before the mixture of the blixing solution") was measured using a Macbeth densitometer. The results obtained are shown in Table 7.

Abbreviations in evaluation of characteristics in Table 7 are the same as those in other tables.

TABLE 7

| Expt. No. | Sample No. | Developing Time (sec.) | Color Development Temperature (° C.) | Ratio of Development Proceeding Velocity (lowermost layer/ uppermost layer) | Minimum Density DBmin | Development Unevenness ($\Delta D_G$) | Influence of Mixture of Blixing Solution ($\Delta E$) | Remarks |
|---|---|---|---|---|---|---|---|---|
| 1 | 208 | 10 | 45.0 | 1.10 | 0.068 | 0.0 | +0.02 | Invention |
| 2 | 208 | 14 | 40.0 | 1.08 | 0.069 | 0.0 | +0.03 | Invention |
| 3 | 208 | 20 | 38.0 | 1.06 | 0.072 | 0.2 | +0.08 | Invention |
| 4 | 208 | 30 | 36.0 | 1.04 | 0.073 | 0.3 | +0.09 | Invention |
| 5 | 301 | 10 | 45.0 | 1.10 | 0.068 | 0.0 | +0.02 | Invention |
| 6 | 302 | 10 | 45.0 | 1.20 | 0.068 | 0.0 | +0.03 | Invention |

Results

Samples in Example 3 are all examples of the present invention. Particularly excellent results could be obtained when the developing time is 14 seconds or less.

Example 4

The above Sample No. 208 was processed to a roll having 127 mm width and subjected to imagewise exposure and continuous processing (running test) with mini-lab printer processor PP728 (manufactured by Fuji Photo Film Co., Ltd.) until the color developing replenisher was replenished two times of the amount of the color developing tank capacity. Processor PP728 was modified so as to be able to arbitrarily change the processing time.

Development Processing

Each processing step was as follows.

| Processing Step | Processing Temperature (° C.) | Processing Time (sec) | Replenishment Rate* (ml) |
|---|---|---|---|
| Color Development | 45 | 12 | 45 |
| Blixing | 40 | 12 | Part A: 17.5 ml<br>Part B: 17.5 ml |
| Rinsing (1)** | 40 | 4 | — |
| Rinsing (2)** | 40 | 4 | — |
| Rinsing (3)** | 40 | 4 | — |
| Rinsing (4)** | 40 | 4 | 90 |
| Drying | 80 | 10 | |

*Replenishment rate per $m^2$ of the photographic material
**Rinsing was conducted in a 4-tank countercurrent system from rinsing (4) to rinsing (1).

Rinsing was conducted in a 3-tank countercurrent system from rinsing (3) to (1).

Rinse cleaning system RC50D (reverse osmosis membrane module, a product of Fuji Photo Film Co., Ltd.) was installed in rinsing tank (3), the rinsing solution in tank (3) was removed, and the removed solution was supplied to RC50D by a pump. The permeated solution obtained from this tank was supplied to rinsing tank (4) and the concentrated solution was returned back to rinsing tank (3). The pressure of the pump was adjusted to maintain the permeation rate of the solution by this reverse osmosis membrane module of from 200 to 300 ml/min. and the system was circulated for 10 hours a day with controlling temperature.

| Color Developing Solution | Tank Solution | Replenisher |
|---|---|---|
| Cation Exchange Water | 800 ml | 800 ml |
| Dimethylpolysiloxane Surfactant (Silicone KF351A, a product of Shin-Etsu Chemical Co., Ltd.) | 0.1 g | 0.1 g |
| Triisopropanolamine | 0.2 mol | 0.2 mol |
| Ethylenediaminetetraacetic Acid | 4.0 g | 4.0 g |
| Potassium Chloride | 10.0 g | — |
| Potassium Bromide | 0.040 g | 0.010 g |
| Sodium Sulfite | 0.1 g | 0.1 g |
| Brightening Agent Hakkol FWA-SF, a product of Showa Kagaku Kogyo Co., Ltd. | 4.0 g | 8.0 g |
| Sodium p-toluenesulfonate | 20.0 g | 20.0 g |
| Disodium-N,N-bis(sulfonato-ethyl)hydroxylamine | 10.0 g | 15.0 g |
| N-Ethyl-N-(β-methanesulfon-amidoethyl)-3-methyl-4-amino-4-aminoaniline·3/2 Sulfate·Monohydrate | 10.0 g | 20.0 g |
| Potassium Carbonate | 26.3 g | 26.3 g |
| Water to make | 1,000 ml | 1,000 ml |
| pH (25° C., adjusted with KOH or sulfuric acid) | 10.30 | 12.65 |

Bleach-Fixing Solution Replenisher

Part A

| | |
|---|---|
| Water | 250 ml |
| Ammonium Ethylenediamine-tetraacetato Ferrate (III) | 0.23 mol |
| Ethylenediaminetetraacetic Acid | 0.02 mol |
| Citric Anhydride | 0.40 mol |
| Water to make | 500 ml |
| pH (25° C., adjusted with nitric acid and aqueous ammonia) | 4.0 |

Part B

| | |
|---|---|
| Water | 100 ml |
| Ammonium Thiosulfate (750 g/liter) | 210 ml |
| Ammonium Sulfite | 90 g |
| Imidazole | 0.2 mol |
| Water to make | 500 ml |
| pH (25° C., adjusted with nitric acid or aqueous ammonia) | 6.0 |

Blixing Tank Solution

Part A and Part B of the above bleach-fixing solution replenisher were added to 500 ml of water in an amount of 250 ml, respectively.

Rinsing Solution (The Tank Solution and the Replenisher are the Same)

| | |
|---|---|
| Sodium Chlorinated Isocyanurate | 0.2 g |
| Deionized water (electric conductivity: 5 μs/cm or less) | 1,000 ml |
| pH | 6.5 |

Results

In the continuous running test in Example 4, the finished photographic quality of the development processing of Sample No. 208 when processed with the above processing condition was stabilized all through the running test. The development proceeding velocity represented by equation (R-1) of Sample No. 208 was 1.1, the minimum density was low, and development unevenness was not generated, thus good results were obtained.

EFFECT OF THE INVENTION

The photographic material and development processing conditions according to the present invention, which were designed so as to satisfy equation (R-1) or equation (R-3), in particular equation (R-2), can perform rapid development, e.g., 30 seconds or less, particularly 14 seconds or less, without bringing about stain on the white background, development unevenness, and the sensitivity fluctuation of a cyan-coloring layer by the color developing solution mixed with a blixing solution. According to the development processing method of the present invention, rapid development can be conducted with maintaining photographic characteristics stable.

While the invention has been described in detail and with reference to specific examples thereof, it will be apparent to one skilled in the art that various changes and modifications can be made therein without departing from the spirit and scope thereof.

What is claimed is:

1. A multilayer silver halide color photographic material, wherein when the multilayer silver halide color photographic material is development processed with a color developing solution containing a p-phenylenediamine derivative as a color developing agent, the relationship between the development proceeding velocity a of the lowermost layer of the constituting emulsion layers of the photographic material and the development proceeding velocity b of the uppermost layer satisfies the following equation (R-1):

$$0.65 \leqq a/b \leqq 2.0 \quad \text{(R-1)}$$

provided that the development proceeding velocity is expressed by the reciprocal of the developing time required for the density value by development to reach ½ of the maximum density.

2. The multilayer silver halide color photographic material as claimed in claim 1, wherein the relationship between the development proceeding velocity a of the lowermost layer of the constituting emulsion layers of the photographic material and the development proceeding velocity b of the uppermost layer satisfies the following equation (R-2):

$$1.0 < a/b \leqq 1.5 \quad \text{(R-2)}$$

provided that the development proceeding velocity is the velocity as defined in claim 1.

3. The multilayer silver halide color photographic material as claimed in claim 1 or 2 which comprises a support having provided thereon at least a blue-sensitive emulsion layer, a red-sensitive emulsion layer and a green-sensitive emulsion layer, wherein the blue-sensitive emulsion layer is positioned farther than at least any one of other emulsion layers from the support.

4. The multilayer silver halide color photographic material as claimed in claim 1 or 2 which comprises a support having provided thereon at least a blue-sensitive emulsion layer, a red-sensitive emulsion layer and a green-sensitive emulsion layer, wherein at least one of said emulsion layers comprises grains having a halide composition having a silver chloride content of 95 mol % or more.

5. The multilayer silver halide color photographic material as claimed in claim 1 or 2 which comprises a support having provided thereon at least a blue-sensitive emulsion layer, a red-sensitive emulsion layer and a green-sensitive emulsion layer, wherein 50% or more of the projected area of entire silver halide grains in said blue-sensitive emulsion layer is occupied by the grains having an average aspect ratio of 2 or more.

6. The multilayer silver halide color photographic material as claimed in claim 5 which comprises a support having provided thereon at least a blue-sensitive emulsion layer, a red-sensitive emulsion layer and a green-sensitive emulsion layer, wherein at least one of said emulsion layers comprises grains having a halide composition having a silver chloride content of 95 mol % or more.

7. The multilayer silver halide color photographic material as claimed in claim 3 which comprises a support having provided thereon at least a blue-sensitive emulsion layer, a red-sensitive emulsion layer and a green-sensitive emulsion layer, wherein 50% or more of the projected area of entire silver halide grains in said blue-sensitive emulsion layer is occupied by the grains having an average aspect ratio of 2 or more.

8. The multilayer silver halide color photographic material as claimed in claim 4 which comprises a support having provided thereon at least a blue-sensitive emulsion layer, a red-sensitive emulsion layer and a green-sensitive emulsion layer, wherein 50% or more of the projected area of entire silver halide grains in said blue-sensitive emulsion layer is occupied by the grains having an average aspect ratio of 2 or more.

9. A method for development processing the multilayer silver halide color photographic material as claimed in claim 1 with a color developing solution containing a p-phenylenediamine derivative as a color developing agent, wherein the development is performed in a manner that the relationship between the development proceeding velocity a of the lowermost layer of the constituting emulsion layers of the multilayer silver halide color photographic material and the development proceeding velocity b of the uppermost layer satisfies the following equation (R-1):

$$0.65 \leqq a/b \leqq 2.0 \quad \text{(R-1)}$$

provided that the development proceeding velocity is expressed by the reciprocal of the developing time required for the density value by development to reach ½ of the maximum density.

10. A method for development processing a multilayer silver halide color photographic material with a color developing solution containing a p-phenylenediamine derivative as a color developing agent, wherein the development is performed in a manner that the relationship between the development proceeding velocity a of the lowermost layer of the constituting emulsion layers of the multilayer silver halide color photographic material and the development proceeding velocity b of the uppermost layer satisfies the following equation (R-1):

$$0.65 \leqq a/b \leqq 2.0 \quad \text{(R-1)}$$

provided that the development proceeding velocity is expressed by the reciprocal of the developing time required for the density value by development to reach ½ of the maximum density.

11. The method for development processing a multilayer silver halide color photographic material as claimed in claim 10, which comprises a support having provided thereon at least a blue-sensitive emulsion layer, a red-sensitive emulsion layer and a green-sensitive emulsion layer, wherein at least one of said emulsion layers comprises grains having a halide composition having a silver chloride content of 95 mol % or more.

12. The method for development processing a multilayer silver halide color photographic material as claimed in claim 10 or 11, which comprises a support having provided thereon at least a blue-sensitive emulsion layer, a red-sensitive emulsion layer and a green-sensitive emulsion layer, wherein 50% or more of the projected area of entire silver halide grains in said blue-sensitive emulsion layer is occupied by the grains having an average aspect ratio of 2 or more.

* * * * *